US010584513B2

(12) United States Patent
Boado et al.

(10) Patent No.: US 10,584,513 B2
(45) Date of Patent: Mar. 10, 2020

(54) FENCE STRUCTURE

(71) Applicant: Harsco Technologies LLC, Fairmont, MN (US)

(72) Inventors: Benjamin Boado, Katy, TX (US); Ivan Gabriel Salcedo Mendoza, Queretaro (MX); Guillermo Rios, Pearland, TX (US); Hector Chavez Mayo, Queretaro (MX); Robert Masten, The Woodlands, TX (US)

(73) Assignee: harsco technologies llc, Fairmont, MN (US)

( * ) Notice: Subject to any disclaimer, the term of this patent is extended or adjusted under 35 U.S.C. 154(b) by 0 days.

(21) Appl. No.: 15/401,865

(22) Filed: Jan. 9, 2017

(65) Prior Publication Data

US 2019/0078350 A1 Mar. 14, 2019

Related U.S. Application Data

(60) Provisional application No. 62/276,225, filed on Jan. 8, 2016.

(51) Int. Cl.

| | |
|---|---|
| ***E04H 17/16*** | (2006.01) |
| ***E04H 17/14*** | (2006.01) |
| ***E04H 17/00*** | (2006.01) |

(52) U.S. Cl.

CPC ..... *E04H 17/163* (2013.01); *E04H 17/003* (2013.01); *E04H 17/1421* (2013.01); *E04H 2017/1447* (2013.01)

(58) Field of Classification Search

CPC ... E04H 17/003; E04H 17/1421; E04H 17/16; E04H 17/161; E04H 17/163; E04H 17/24; E04H 2017/1447; E04H 2017/1452; E04H 2017/1491

USPC ..... 256/11, 55, 65.03

See application file for complete search history.

(56) References Cited

U.S. PATENT DOCUMENTS

| | | | | |
|---|---|---|---|---|
| 1,840,278 | A * | 1/1932 | Rich | E04H 17/06 256/72 |
| 4,899,991 | A * | 2/1990 | Brunkan | E04H 17/1434 256/24 |
| 5,556,080 | A * | 9/1996 | Vise | E04H 17/003 248/74.5 |
| 6,206,347 | B1 * | 3/2001 | Kelley | E04H 17/003 256/1 |
| 7,866,635 | B2 * | 1/2011 | Payne | E04H 17/161 256/24 |
| 8,631,551 | B1 * | 1/2014 | Payne | E04H 17/143 29/428 |
| 8,820,722 | B2 * | 9/2014 | Reinert, Sr. | E04H 17/16 256/65.14 |
| 9,334,672 | B1 * | 5/2016 | Mallory | E04H 17/1421 |

(Continued)

FOREIGN PATENT DOCUMENTS

GB 2507864 A * 5/2014 ..... G08B 13/122

*Primary Examiner* — Matthieu F Setliff

(74) *Attorney, Agent, or Firm* — Withers Bergman LLP

(57) ABSTRACT

A security fence structure including posts, rails, fence gratings, mounting brackets, fence clips and fasteners is easily assembled in the field. The rails are secured to the post by mounting brackets and fasteners, and the fence grating secured to the rails by means of the fence clips and fasteners. The fence gratings, in conjunction with the mounting brackets, fence clips and fasteners are resistant to climbing.

20 Claims, 21 Drawing Sheets

(56) References Cited

U.S. PATENT DOCUMENTS

2006/0226406 A1* 10/2006 Vise ..... E04H 17/10
256/19
2013/0264532 A1* 10/2013 Goodman ..... E04H 17/1439
256/65.08
2015/0225912 A1* 8/2015 Nunes ..... E01F 15/083
256/13.1

* cited by examiner

DETAIL B

SECTION A-A

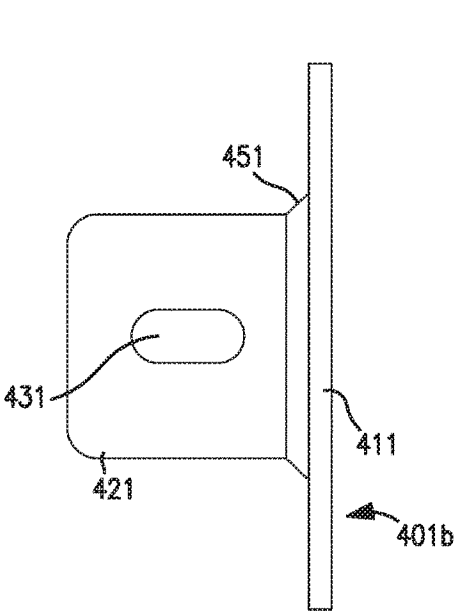
FIG. 4C
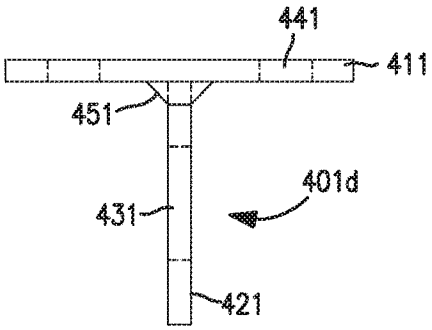
FIG. 4D
FIG. 4B
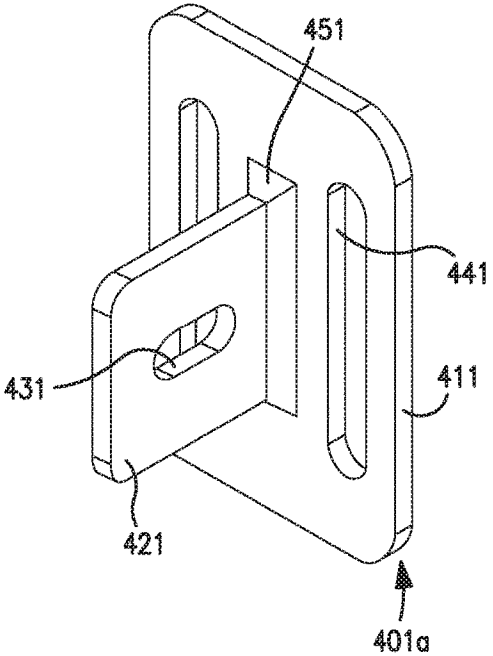
FIG. 4A

DETAIL B

DETAIL C

SECTION A-A

FENCE STRUCTURE

CROSS-REFERENCE TO RELATED APPLICATIONS

This application claims the benefit of U.S. Provisional Application No. 62/276,225, filed Jan. 8, 2016, the contents of which, along with all references cited in this specification and their references, are incorporated herein by reference in their entirety for teachings of additional or alternative details, features, and/or technical background, and priority is asserted from such.

BACKGROUND OF THE INVENTION

Field of the Invention

The present invention generally relates to fencing structures for securing geographical boundaries.

Description of the Related Art

Securing geographical areas requires structures able to withstand physical, and environmental attack. Would be intruders must be thwarted from attempting to overcome the structure by climbing, dismantling, or destroying any or all of the elements that constitute the structure. Environmental resistance must work to maintain performance of the structure under temperature, moisture, and windy conditions.

Prior structures, such as chain link fencing are simple to cut and or climb since the fencing wire is composed of relatively thin gauged material and the shape of the fence pattern provides footholds and handholds for a climber to propel themselves upward. Securing the fence to posts has nominally used bent wire, which easily becomes damaged or destroyed, limiting the effectiveness of the fence.

Other structures have been attempted. However, these typically require welding in the field, which is costly, labor intensive, and detrimental to any environmentally protective treatment the structure may have had.

SUMMARY

There is provided herein an exemplary embodiment of a fence structure comprising: two or more posts, one or more mounting brackets fastened to each of the two or more posts, one or more rails fastened to the mounting bracket and between the posts, one or more fence grating, and one or more fence clips fastened to the one or more rails, wherein the fence clips capture the fence grating, and alternatively wherein one surface of the rail is co-planer with one surface of the post.

Other embodiments provide a fence structure comprising one or more fence grating overlaps of at least one of the two or more posts. Additionally, a fence structure may comprise two or more posts having prefabricated holes to accept fastening of the one or more mounting brackets. One or more of the mounting brackets may comprise a tab. Alternatively an embodiment of a fence structure may comprise one or more mounting brackets comprising a slotted tab; or comprise a pair of slots or a pair of slots in a vertical orientation.

Other embodiments provide a fence structure comprising one or more fence clips comprising a substantially C-shape cross-section. One or more fence clips may comprise a through hole about a center portion of the fence clip. A fence clip may comprise a through hole of square shape with corners oriented vertically and horizontally. And, a fence clip may additionally capture one or more vertical elements of the fence grating.

Other embodiments provide a fence structure comprising two or more posts comprising an overhang portion. Alternatively one or more of the two or more posts may comprise an overhang portion.

Other embodiments provide one or more post comprising a cap. Additionally, one or more posts may perform as a terminal post.

Other embodiment provide two or more posts of a fence structure comprising a cross section of about two inches by four inches.

Other embodiments provide one or more rails of a fence structure comprising a through hole at each end, and alternatively one or more rails may comprise a though hole at each end passing through two common surfaces, a first surface and a second surface. The through holes may be round in shape, or the through holes may be square in shape.

Other embodiments provide one or more rails of a fence structure comprising a series of through slots about their lengths, wherein the one or more rails further comprise a series of through slots passing through two common surfaces, a first surface and a second surface. The slots may alternatively pass through two opposing surfaces of a rail.

Other embodiments provide one or more fence clips of a fence structure comprising one or more ends, wherein the one or more ends are tapered.

Other embodiments provide a fence structure comprising two or more posts, one or more mounting brackets fastened to each of the two or more posts, one or more rails fastened to the mounting bracket and between the posts, one or more fence grating, and one or more fence clips fastened to the one or more rails, wherein the fence clips capture the fence grating, and alternatively wherein one surface of the rail is co-planer with one surface of the post and one or more slots in one or more mounting brackets, wherein one or more slots in the one or more mounting brackets in conjunction with two or more posts and one or more slots in the one or more rails, provide freedom of movement during assembly of the fence structure.

Other embodiments provide a fence structure that further comprises one or more security fasteners to join the fence grating to the rail, the rail to the mounting bracket and the mounting bracket to the post.

BRIEF DESCRIPTION OF THE DRAWINGS

FIG. 1A, a front view, depicts a fence structure with a fence grating installed. FIG. 1B illustrates a top view of that shown in FIG. 1A. FIG. 1D depicts a side view of that shown in FIG. 1A. FIG. 1C depicts an enlarged view of a slotted rail. FIG. 1E depicts a mounting bracket assembly with fasteners. FIG. 1F depicts a fastener assembly. FIGS. 1G, 1H, 1I and 1J depicts a detailed side view, a detailed front view, a detailed top view, and a detail isometric view of the mounting arrangement of the fence structure.

FIG. 2D depicts an exemplary straight fence post. FIGS. 2A, 2B, 2C, and 2E illustrate a front, side, cross section and detailed view respectively of that depicted in FIG. 2D. FIG. 2F depicts an exemplary post cap.

FIG. 3D depicts an exemplary overhang fence post. FIGS. 2A, 2B, 2C, and 2E illustrate a front, side, cross section and detailed view respectively of that depicted in FIG. 2D before the upper portion is bent to form the overhang. FIG. 2F depicts an exemplary post cap.

FIG. 4A-4D illustrates various views of an embodiment of a mounting bracket. FIGS. 4B, 4C and 4D illustrate a side, front and top view of the mounting bracket depicted in the isometric view of FIG. 4A.

FIG. 5A is further illustrated in the detailed views of FIGS. 5B and 5C, as well as the side, isometric and section view of FIGS. 5D, 5E and 5F respectively.

FIGS. 7A-7C depict a top, front and isometric view of an exemplary fence clip; as do FIGS. 7E-7G, FIGS. 7I-7K and FIGS. 7M-7O. Exemplary fence clip assemblies are depicted in FIGS. 7D, 7H, 7L, and 7P. FIGS. 7Q and 7R depict an isometric and top view of exemplary fence clips.

DETAILED DESCRIPTION OF THE INVENTION

Figure 1D:
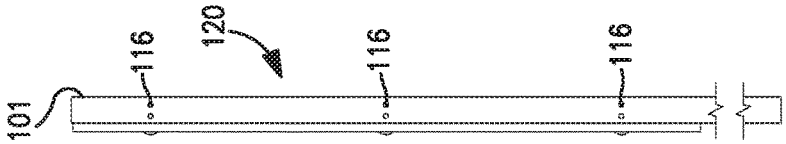
FIG. 1A to FIG. 1J illustrates various views of embodiments of various fence structure components, such as posts, rails, grating, mounting bracket assemblies, fence clips, post cap, security bolts, washers, security nuts, and carriage bolts.

An area requiring a secured and defined perimeter may incorporate a security fence structure. The fence structure described herein advances the high security fence industry by offering: 1) a geometric scalability deterrent, 2) a high strength to weight ratio, and 3) price effective costs. Security fence structures require resistance to both environmental and physical attack. Maintaining the integrity of the fence structure is paramount when an area is to be secured from unwanted intruders, or for reasons of safety. The structure allows for easy assembly in the field, and has a low wind resistance all the while demonstrating high anti-climb and anti-damage resistance. In an attempt to scale the fence structure the spacing, depth and edges of the bearing bars create an obstacle to finger entry, and contorted grasp. The high strength-to-weight ratio distributes impact loading evenly and would require heavy duty power tools to penetrate. Cost effectiveness created by the fence structure starts with lower-cost volume production of the fence grating, efficient transportation/installation of the fence grating, and flexibility of the system to adjust to field conditions.

Various applications of the fence structure can be envisioned. Government applications offer a unique combination of security, visual deterrence and pleasing aesthetics. Substantial high strength steel bars and rods which are fully fusion welded enhance the inherent anti-climb properties, making any attempts at breaching the fence a noisy endeavor requiring heavy duty power tools. With product height configurations up to and beyond twenty feet tall, the fence structure is a well suited when securing any Governmental or Military facility. Protecting the critical infrastructure of our nation's power grid and water supplies, in utility applications for example, is at the forefront of security due to recent events domestically as well as globally. The fence structure's imposing presence can initiate a deterrence factor of would-be thieves as well as domestic and international terrorist activities and finishes with a barrier difficult to breach. In Oil and LNG, the risk of potential toxins, caustics, and explosive chemicals/gases are all associated with an escalating need for enhanced security. These facilities require a stringent fence structure to prevent the possibilities of mass illnesses, injury or loss of life. The Fence structure can be integrated with electronic and personnel security measures in order to maximize Detection, Deterrence, Delay and Denial of would-be intruders. Transportation infrastructure at not only airports, but ports of entry, railroads, and our country's borders can use the fence structure as described herein. The Fence structure described can be a solution for all areas of transportation facilities that need to direct or control pedestrian movements and limit access to secure areas for non-essential personnel. In data, communication, and financial environments the safeguarding of virtual records, transactions and information are critical components to protect from attack. Facilities that host these services require controlled entry points with dual factor authentication procedures, multiple utility redundancies, hardened buildings, and surveillance needs both internal and external. The fence structure, can be a first line of defensive barrier, and as an integral component in the overall physical security design to ensure these installations are protected against theft, corporate espionage and terroristic activities.

Various components comprise a fence structure of the present invention with the intent of maintaining strength and resistance to physical and environmental abuse, maintain integrity while allowing for variable terrain, permit the installer with favorable installation tolerances, and provide an assembly methodology of simplistic design. The fence structure can be manufactured offsite and easily transported to remote locations wherein the structure can be assembled with the minimum of tools and without the need for welding. The materials comprising the various components can be manufactured of steel, stainless steel, or other materials, which satisfy the conditions. The materials may be treated (individually or as assemblies), such as by galvanization, powder coating, painting, surface hardening or other known treatments. Materials of the fence structure may even be of mixed specification, such that some components, for example, are stainless steel while others are hot dip galvanized. However, materials should be chosen based on galvanic compatibility—the process by which materials in contact with each other oxidize and/or corrode. The size and gauge of the various elements may also vary dependent on the project scope and cost requirements. Wall thickness and plate thickness may be chosen and/or fabricated to meet various specifications, including, but not limited to, bend strength, tension, or compression loading requirements.

The fence structure of the present invention comprises two or more vertical fence posts, two or more rails, one or more fence grating, a multitude of mounting bracket assemblies, a multitude of fence clips, and associated fasteners and hardware. Fence structures can be fashioned by erecting multiple posts to support the railing via the mounting bracket assemblies. A typical fence structure may exhibit two posts spanned by the rails fastened between the posts. A mounting bracket can connect the post and rail together utilizing the appropriate fasteners. Fence grating is mounted to the railing by use of the fence clips and fasteners. Lengths of fence can be fashioned by adding additional posts, rails, and grating to accommodate and define the desired enclosure.

Posts: A fence system may require a multitude of posts spaced at substantially regular intervals. Within the fence system, a post may be an intermediate post, a corner post, or a terminal post. Fence posts, inserted into the ground to a depth of thirty-six inches, to forty-eight inches (36 to 48 inches) provide a vertical structure to which the remaining elements are attached directly or indirectly via brackets and fasteners. Alternative depths may be used or necessary dependent on the conditions of the remote site in which the fence structure is destined. Common practice is to set the subterranean depth of the post approximately one third the overall projected length. For example, a 3.33 meter post may have 2.50 meters of the fence post above ground and 0.83 meters of post below ground. Fence posts may, alternatively, be surface mounted to a concrete foundation/footing after welding a plate to the bottom of the post and using security type fasteners or by core drilling the post into a concrete footer and securing using a hydraulic cement or epoxy. Posts are generally oriented in a vertical position.

Fence posts may be constructed of high strength steel or other materials as previously discussed. A favorable shape for the post is a rectangular box tube having a nominal cross section of substantially 2 inches by 4 inches (2×4). Other sizes and shapes may be used where necessary or desired, such as hexagonal. For example a corner post may be constructed from a box tube having a cross section of substantially 4 inches by 4 inches (4×4). Posts may have a series of holes or pair of holes provided and spaced along their length on one or more sides. In the case of a 2×4 post (nominal dimensions) holes or pairs of holes may be provided only on each 4-inch wide surface (opposing sides) down, it's length. In one exemplary embodiment, three pairs of holes may be provided on each of the four inch wide surfaces spaced at regular intervals down its length, and at a predetermined distance from the top (or bottom) of the post. Corner posts may have a series of holes or pair of holes provided down adjacent sides, and posts of various cross sections, such as substantially triangular may be fashioned.

A post cap may be fabricated as part of the post design to prevent moisture from collecting inside the post, thereby preventing corrosion. A post cap can increase strength and resistance to attack as well. Caps may be fabricated from various materials and joined to the top of the post. Caps may also be welded to the post during the fabrication process; prior to any surface treatment and provided with a hole to aide in immersion and drainage. In an alternative arrangement, the cap may be a replaceable polymer cap, which can further reduce costs and may, or may not, have a hole.

In one embodiment one or more posts may incorporate an overhang feature at the upper portion, which once the post is installed on site, extends in an upward angle away from the secured side of the fence structure. To incorporate this feature the upper portions of fence posts may be fabricated with a substantially V-shaped notch extending from one side to about the inner surface of the opposing wall of the tube. The upper portion is thereafter bent during fabrication to close the notch and welded along the joining edges. The post may then be surface treated. This construction provides a more robust overhang while lessening the total number of parts required in the field and reduces the installation time.

Mounting Bracket Assemblies: Join to the post at predetermined locations down the post length, such as by holes or hole pairs. Each post may require one or more mounting bracket assemblies. Typically, an intermediate post may have a minimum of 4 mounting bracket assemblies. Each mounting bracket assembly comprises a substantially rectangular plate and a tab plate welded to each other at a right angle about the center of the rectangular plate, forming a T-shaped cross section. The weld joins one edge of the tab plate to about a centerline of the substantially rectangular plate. Elongated through holes (slots), fabricated into the rectangular plate either side of the tab plate broad surfaces, are oriented parallel with the tab plate broad surfaces and may form part of an integral design in allowing for grade change capabilities as well as creating a tolerance of ±2" vertical placement for setting of post height during the installation process. A single slot may be fabricated into the rectangular plate of the mounting bracket assembly; however, a pair of slots (in conjunction with the associated fasteners) exhibits improved resistance to rotation as well as increasing horizontal impact shear resistance.

A further slot is fabricated into the tab plate of the mounting bracket assembly; oriented perpendicular to the weld joining the plates. The relative orientation of the slots in the mounting bracket provides differential freedom of movement during installation of the fence structure. As shown in the figures, one exemplary embodiment may orient the mounting bracket assembly with the pair of rectangular plate slots vertical, thereby providing vertical freedom of movement relative to the post. In this arrangement the tab plate slot would provide additional freedom of movement, but in the horizontal direction. Other arrangements can be made. For instance the mounting bracket may be oriented to allow horizontal freedom of movement with respect to a fence post.

In practice one or more mounting bracket assemblies are joined to each fence post using fasteners through the pair of slots and into the post's holes, as described above. Security bolts and blind nuts may be used to secure the mounting bracket assembly to the fence post. The security bolts may pass partially through the fence post, such as to not interfere with an opposing fastener/nut from the opposite side of the post. Alternatively a security through bolt and security nut may be used to fasten two mounting plates to opposite sides of the same post. A security nut may have a portion having a threaded internal shape and a tapered external shape joined to an externally hex shaped driving portion with a clearance internal diameter, such that the hex shaped portion does not engage the threads and breaks at the joint of the two portions when sufficient torque is applied to the hex portion during installation of the security nut. In one embodiment an intermediate post may have fastened thereto three or more mounting bracket assemblies to two opposing sides of a post. Mounting bracket assemblies may alternatively be formed as a hinge to allow a fence structure to turn at irregular angles about a post. For example, a fence may require a change in direction of thirty seven degrees (37°), where fabricating a post to accommodate such an angle using a standard mounting bracket would be possible, but not be practical.

Rails: fence rails are joined at their ends to mounting bracket assemblies between fence posts. Rails are fabricated and installed with the mounting bracket assemblies to align the intruder side surfaces in a substantially co-planer arrangement, thus creating a flush support structure to accept fence grating, (further described below). Box tubes, having a rectangular or square cross section, may be used and provide a high strength to weight ratio; although other shapes are possible, including round cross sections, or channel (which may be used to shield fasteners). Various dimension rails may be used and a fence structure may incorporate rails of differing dimension. For example, a bottom rail may exhibit a cross section with a higher dimension than those of a mid-height or top rail. Following the terrain over which the fence structure passes, rails may be horizontal or set at an angle different than horizontal, such that the rail follows the terrain and provides adequate support for the structure.

Rails may be fabricated with through round, square, keyed, or slotted holes in opposing sides and at each end of the rail, allowing a fastener to pass through the cross section and into the mounting bracket assembly tab plate slot. At intermediate locations along the rail length and between the though holes, the same opposing sides may exhibit these holes fabricated into the rail. These holes also allow fasteners that attach the grating and clip to pass through the cross section of the rail and provide some freedom of movement while installing the fence structure. These locations holes permit the installer to modify the rail to accommodate shorter spans as required. The midspan of the rail might not contain such a hole, thereby increasing the strength of the rail section where the bending moment is highest and maximum deflection generally occurs.

Grating: Fence grating, post size and rail dimensions, are sized such that fence grating may overlap each post providing a predetermined grating gap to each adjoining fence grating. Fence grating is comprised of a multitude of vertical and horizontal elements. Spaced apart from one another the multitude of vertical elements, are held apart and joined by a multitude of horizontal elements spaced vertically to a common edge of the vertical elements. Customized to accommodate installation or local requirements the overall size of the fence grating can also be standardized to fixed heights and/or widths. The grating may also be adapted to follow uneven terrain. For example, the grating may be extending independently at each vertical and horizontal element to account for undulating terrain. The grating may also be extended as a unit to account for changes in terrain, such as when traversing down a wall face or other vertical feature. In addition, the grating and structure may make use of both characteristics combined to follow terrain. For terrain following, fence gratings can be fabricated such that one fence grating or multiple fence gratings are required for each post-to-post spacing.

Vertical elements of the fence grating provide strength and climb resistance while the horizontal elements tie the vertical elements together at a desired spacing while allowing wind to pass through. High resistance to climbing and low wind resistance can be achieved with the vertical elements joined about their narrow edge, at or about ninety degrees to the horizontal elements. The vertical elements having a proximal edge and a distal edge may be spaced relatively close and joined about their proximal edge in similar fashion to a common side of the evenly spaced horizontal elements. In such an arrangement, the installed fence grating may be oriented such that the horizontal elements, joined about the proximal edge of the vertical elements, are directed toward the secure area and opposite the would be intruder. In this manner a fabricated and installed fence grating may comprise a substantially deep cross section, relative to distance of the vertical element distal edge to the horizontal element locations (and in combination with substantially narrow spacing between the vertical elements), that the horizontal elements are beyond a person's ability to grasp by finger or hand when installed with the vertical elements oriented toward the would be intruder.

An alternative arrangement can be fabricated such that the horizontal element is sandwiched between a multitude of vertical elements, wherein the vertical elements on each side of the horizontal elements are either vertically aligned or offset from one another. Surface treatment, as described above, may be applied to the fence grating as an assembly.

Vertical Elements: Vertical elements may be flat bar-stock, having a cross section width in the range of one half inch (½") to two inches (2") or more and a cross section thickness in the range of one eighth inch (⅛") or less to one quarter inch (¼"). Other cross section dimensions are possible. Cylindrical tube or rectangular tube (including square tube) may replace flat bar stock as an alternative choice in material shape. One or more notches may be incorporated into the vertical elements at various positions down one side or edge and positioned such that the horizontal elements align and fit into the notches where they are welded during manufacture. A sharp edge, similar to a knife edge, distal to the horizontal elements (and presented to a would-be intruder) may be incorporated into the vertical elements, thus increasing the deterrent to scale the fence structure. Vertical elements may also exhibit a sharp end similar to a spear, to likewise act as a deterrent.

Horizontal elements may be circular bar, rectangular bar (including square), or other structural material and may be twisted down their length prior to joining with the vertical elements. Spacing of the horizontal elements may be between one and five inches. Higher or lower spacing dimensions may be dictated by the necessity to limit distortion of the vertical elements, without adding unnecessary weight. For example, an eight foot tall fence grating may be fabricated to have 47-49 horizontal elements dependent on the layout, such as if a horizontal element is held back from the ends of the vertical elements.

Multiple fence clips are fabricated and installed via fasteners to retain the fence grating to one or more horizontal fence rails. Multiple fence clips may be used in conjunction with associated fasteners to fasten each fence grate to the specified number of fence rails. For example, a fence grate may be fastened to three fence rails by six fence clips; two fence clips per fence rail. Dependent on the alignment of the post and rail, fence clips may secure each grating to result in zero clearance or a gap where a fence grating overlaps with a post. Fence clips can be fabricated from flat bar-stock and may have a substantially 'C' shaped cross section and retain a portion of a fence grating by spanning two or more vertical elements of a fence grating. Fence clips may also be made with other methods such as mold casting and form other shapes, such as a 'W' in order to retain the fence grating to the rail. A fence clip having a span able to trap two vertical elements of the grating provides the least horizontal surface to gain a hand or foot hold, while limiting any pry or twisting abuse. The end portions of the clip, when installed may provide substantially near zero clearance to the rail. Alternatively the clip may be fabricated to provide a 1/16" to 1/8" clearance; or the fence clip may be fabricated to protrude into the rail slots by nature of a tab at the ends of each clip, thereby preventing twisting, or abuse by prying. Clips may be fabricated from bar-stock with narrowing tapers about their ends to further enhance pry resistance, then bent into the C-shape.

Within the mid portion of each clip resides a hole through which a fastener may pass to secure the clip, and associated fence grating, to one or more rails through the intermediate rail slots. The fasteners having a smooth head pass through the fence clip, between vertical and horizontal elements into and through the rail wherein the fastener is secured with a nut, such as a security nut (or in some fashion to resist removal, such as peening).

Figure 1A:
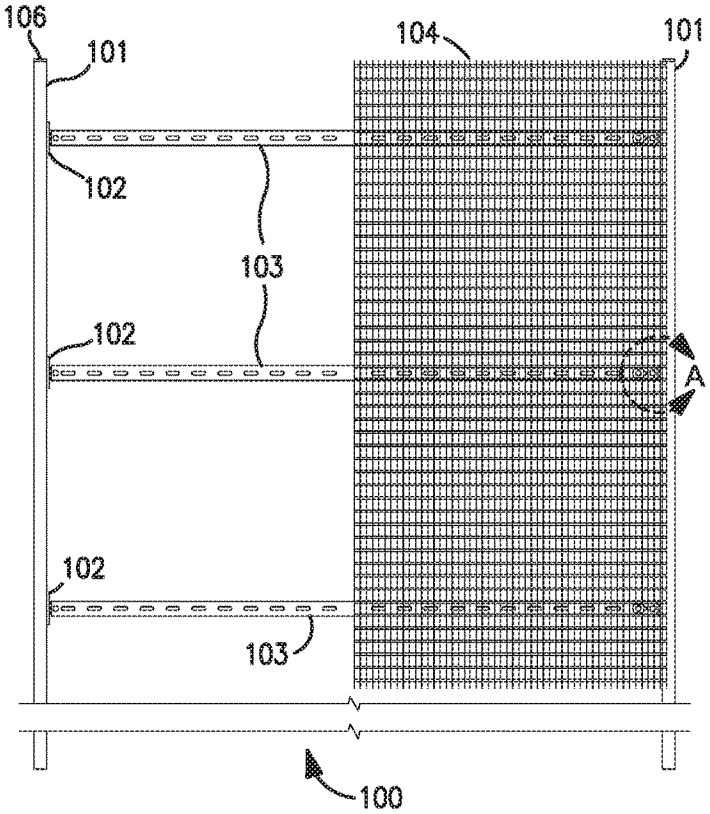
Figure 1B:
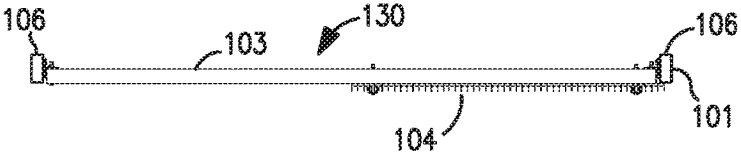

The exemplary figures provided show and support the various embodiments described herein. Depicted in FIGS. 1A-1J are diagrammatic representations of various fence structure components. A partially assembled portion of a perimeter fence structure is depicted (FIG. 1A front 100, FIG. 1D side 120, and FIG. 1D top 130), along with a rail 103 (FIG. 1C), a mounting bracket assembly 102 (FIGS. 1A, 1E, 1I, 1G) with vertical slot fasteners 107 (FIG. 1E), with washers 108 (FIG. 1E) and rail post fastener 111 (FIG. 1E, 1I), with washer 108, a fence clip 105 (FIG. 1F, 1G-1J) with fastener comprised of bolt 110 (FIGS. 1F, 1G-1J) and security nut 115 (FIG. 1F, 1I), and various detail views of an exemplary mounting arrangement at the mid-height rail. Shown for a two fence gratings per post spacing, the front view 100 of FIG. 1A illustrates one of the two fence gratings 104 secured to the rails 103 via six fence clips 105 and associated fasteners 110, and 115 (two per rail per grating). In turn the depicted side view 120 of FIG. 1D illustrates the paired holes 116 in three pairs down the extent of the post 101 to accept the mounting bracket assembly fasteners 105, 110, and 115, with the paired slots 117*a* and 117*b* (FIG. 1E, 1G) aligned vertically (as further depicted in the detailed view described below in FIGS. 4A-4D). Paired holes 116 can number from eight to sixteen or more. Fence caps 106 (FIGS. 1A, 1B) are best shown in the depicted top view 130 of the fence structure, as well as the protruding fence clip 105 and fasteners 110 and 115 about front and secured (or back) side of the rail 103.

Figure 1C:
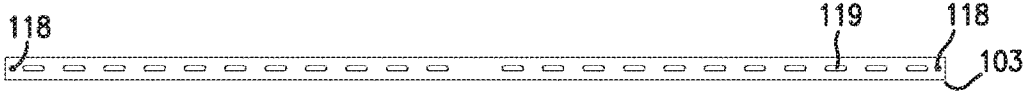
Figure 5A:
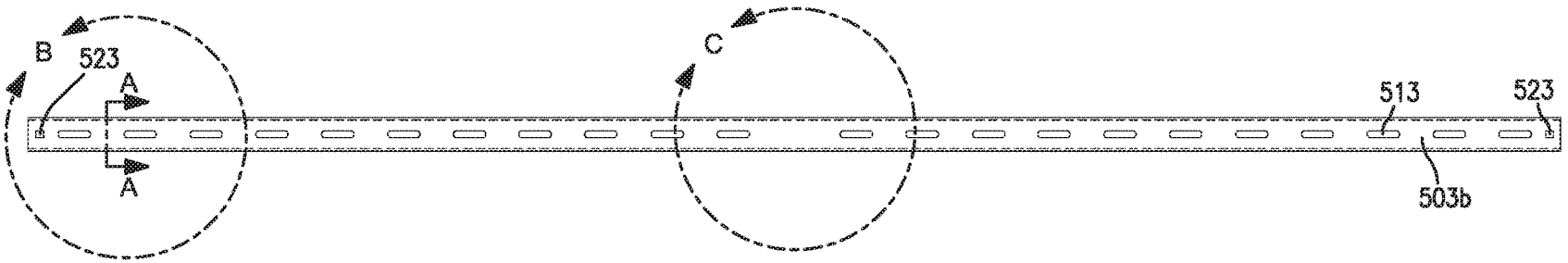
FIG. 5A-5F illustrates various views of an embodiment of a fence rail. The front view of an exemplary fence rail
Figure 5B:
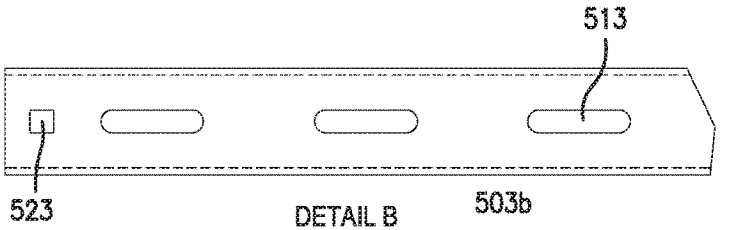
Figure 5C:
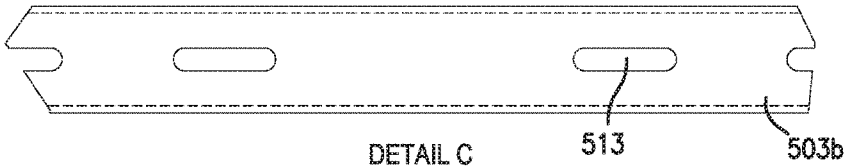
Figure 5D:
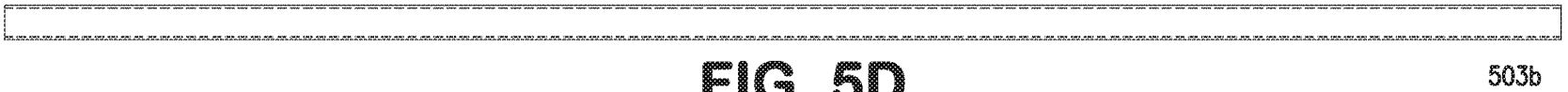
Figure 5F:
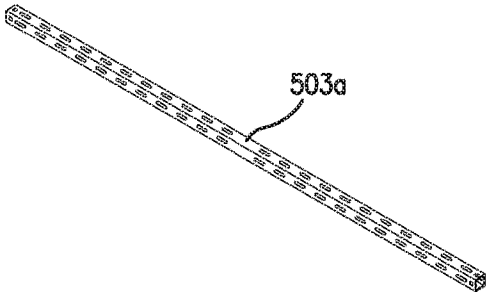
Figure 5E:
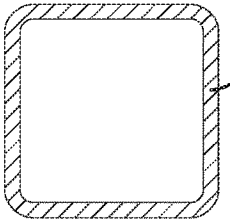

The rail 103 shown at least in FIG. 1A, 1C exhibits through holes 118 at both ends and the intermediate through slots 119, as also described further below with respect to FIGS. 5A-5C. The through holes 118 in the common surface may be duplicated on the opposing surface of the rail such that a fastening bolt may pass completely through the rail. The slots 119 may also be duplicated on the opposing surface of the rail. In the embodiment shown in FIGS. 1A, 1C (and slots 513 of FIGS. 5A, 5C, and 5E), the slots 119 are absent from the center portion of the rail, although the rails may have equally spaced slots down the entire length. End holes 118 may alternatively be slots, differing from what is shown in the figure. Alternatively the rail 103 may provide slots 119 on one surface along its length while the opposing side of the rail is open, such as might be found in a channel. The rail 103, as described above, can be of various cross sections, including round or rectangular, however, the rail 103 as depicted by the combined detail views, illustrates a substantially square cross section.

Figure 1G:
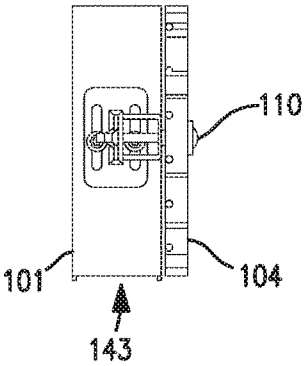
Figure 1J:
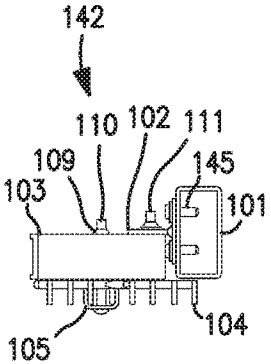
Figure 1F:
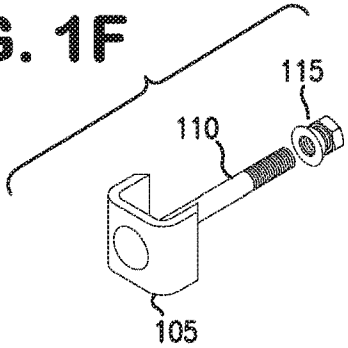
Figure 1I:
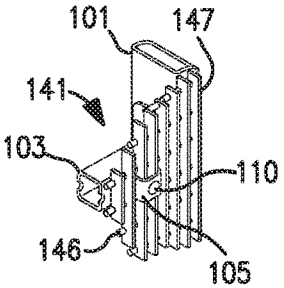
Figure 1E:
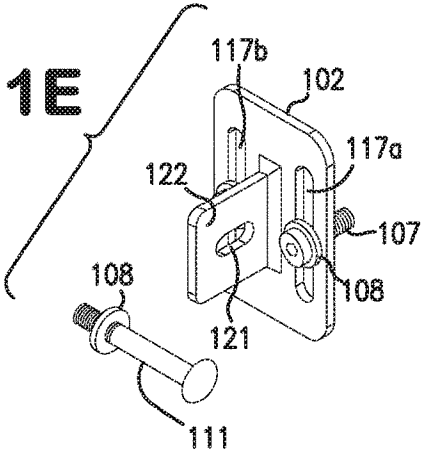

Depicted in FIG. 1E, exemplary mounting brackets 102 show paired slots 117*a*, 117*b* fabricated within the substantially rectangular plate, and a perpendicular slot 121 fabricated into the tab 122, as described above. Demonstrating the fastener placement, paired security fasteners 107 are set into the paired slots 117*a*, 117*b* with accompanied washers 108 and threaded holes 116 which may be replaced with thru-bolts or blind rivet nuts in the post 101. A rail 103 to mounting bracket assembly 102 fastener bolt 111 and washer 108, less break away nut, is shown with the mounting bracket assembly 102.

The fence clip 105 depicted in the figures shows a C-shaped cross section with the ends squared to the long edge and beveled from the front surface to the rear surface and a carriage bolt 110 type fastener installed, with the accompanied washer 108 and security nut 115. The fence clip ends can be fabricated to comprise a tapered angle or tab, as further depicted in FIGS. 1F, 7B-7D, 7F-7H, 7J-7L, and 7N-7R. Fasteners are used in the construction of the fence structure such that the integrity of an applied surface finish can be maintained and the need for a skilled welder and equipment are diminished.

Figure 1H:
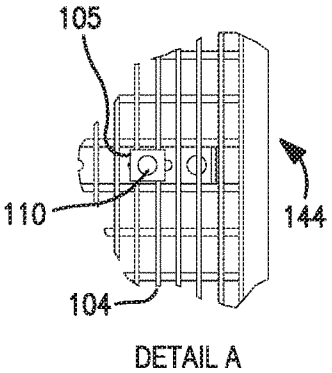
Figure 2E:
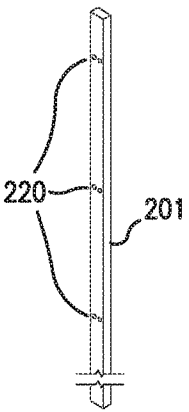
FIGS. 2A-2F illustrates various views of an embodiment of a straight fence post and post cap.
Figure 2A:
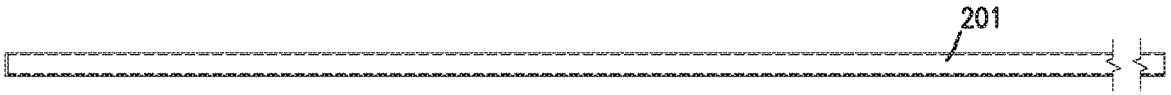
Figure 2B:
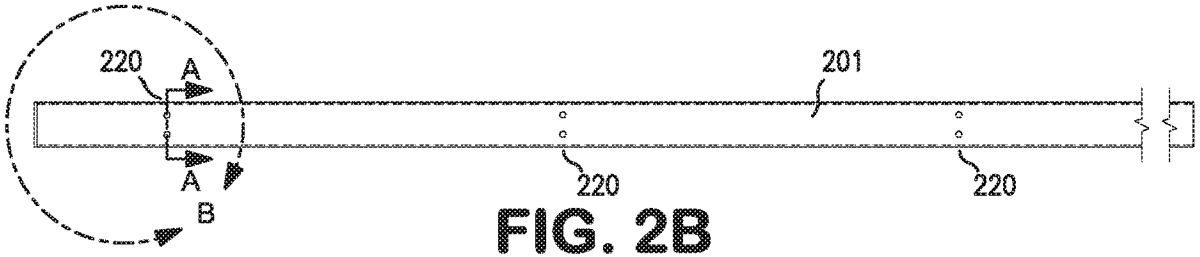
Figure 2D:
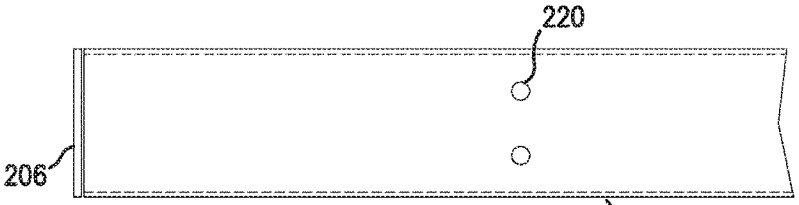
Figure 2F:
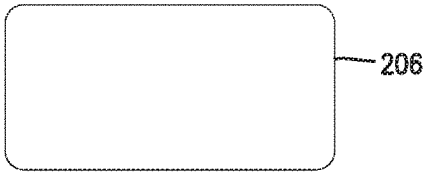
Figure 2C:
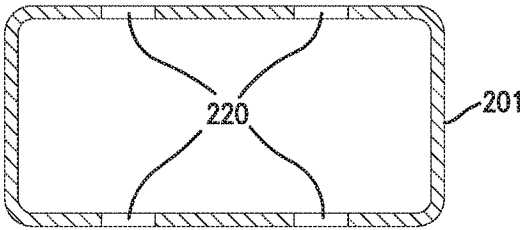
Figure 3A:
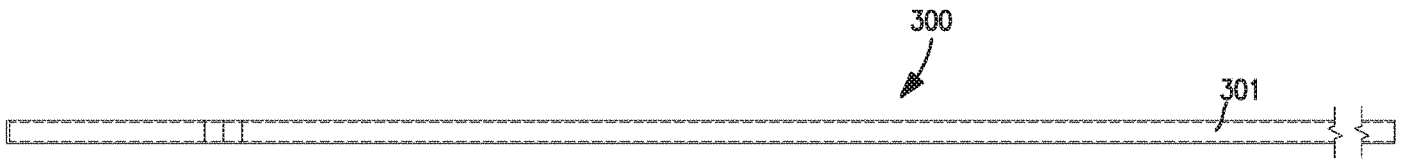
FIGS. 3A-3F illustrates various views of an embodiment of an overhang fence post.
Figure 3B:
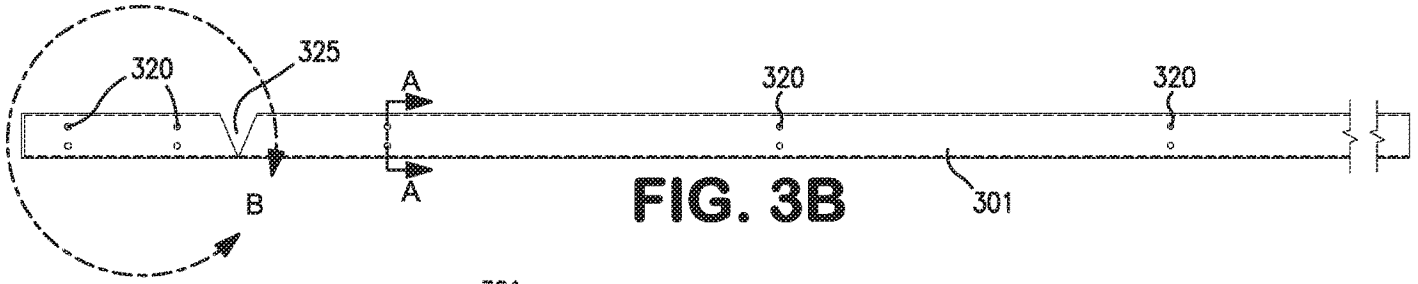
Figure 3D:
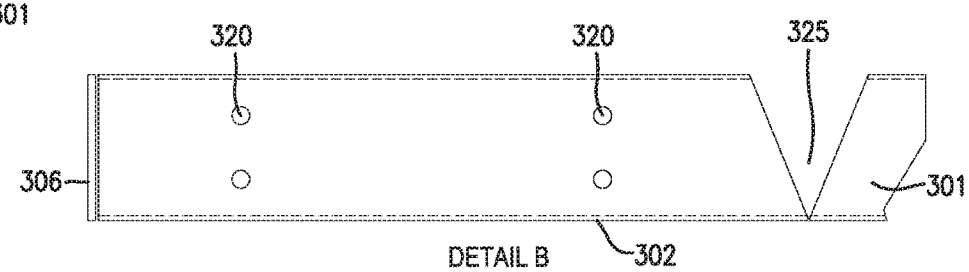
Figure 3E:
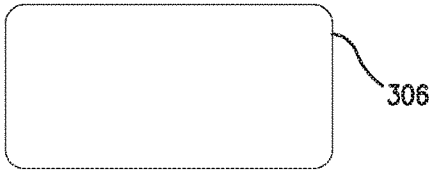
Figure 3C:
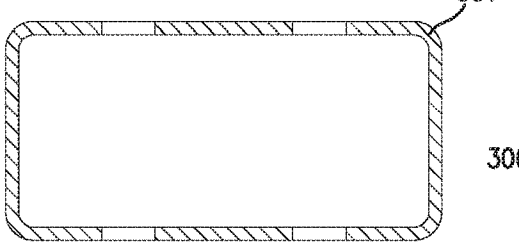
Figure 3F:
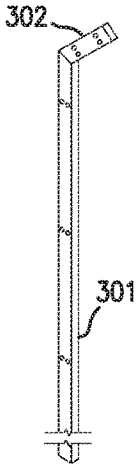

The detail views of the mounting arrangement, shown in FIGS. 1G, 1I, 1G, 1H respectively, depict an isometric 141, top 142, side 143 and front 144 view. The top view 142 depicts fence post 101 showing a fastener bolt 110 passing through a fence clip 105 and fence grating 104 securing the grating 104 to a rail 103, wherein the rail 103 is secured via a mounting bracket 102 and fastener bolt 111 and washer 108 to a fence post 101 via mounting bracket paired security fasteners 107 and washers 108 to blind nuts 145. The fence grating 104, overlapping the post 101 and providing a clearance between the post 101 and fence grating 104 interface, is shown. Shown also are the mounting bracket 102 to post 101 fasteners: bolt 111, washer 108, and blind nut 145 (blind nut confined within the post), such as might be used if similar fasteners are used to join an adjoining fence grate to the left.

In both the top view 130 of the perimeter fence section and the detailed top view 142, the substantially coplanar arrangement of the rail 103 and post 101 are shown. In the detailed top view 142, the fence grating 104, and other components are installed to provide a substantially small gap between the back of the fence grating 104 to the front of the post 102. This gap may be reduced, such that no gap or substantially no gap, is provided.

Depicted by the detailed side view 143 (FIG. 1G), the mounting bracket assembly 102 is shown with the mounting bracket assembly 102 to post 101 fasteners (bolt 111, and washers 108) installed slightly below center. The arrangement might very well be offset in an opposite direction or more to the same dependent on the alignment correction necessary for the post-to-post rail installation. The side view 143 and the isomeric view 141 (FIG. 1J) further depicts the horizontal elements 146 of the fence grating 104 attached to a common side of the vertical elements 147 and relieved into the vertical elements 147 edges by a weld forged resistance weld process. Fence clip 105 offset, provided for by the rail slots 119, is illustrated in the detailed front view 144 (FIG. 1H) depicted in the figure; wherein some portion of the slot 119 is visible to the right of the fence clip 105. The slot 119 allows the clip 105 to be secured, allowing for alignment corrections during installation at the remote site. As further shown in the detailed front view 144, the rail 103 to mounting bracket 102 assembly fastener bolt 111 head is shown behind the vertical element 147 of the fence grating 104. The mounting bracket 102 assembly to post 101 front fastener bolt 107 is also depicted in the top view 142 and side view 143 as trapped within the confines of the rail's interior volume. The head of the fastener bolt 111 may rest against the front of the rail with the bolt shank of sufficient length passing through both sides of the rail 103 into the mounting bracket tab 122 and fastener nut. Alternatively, the fastener bolt 111 may be shorter and pass through the rear portion of the rail to attach the rail to the mounting bracket 103, thereby not interfering with a flush abutment of the back of the fence grate 104 to the rail 103.

Fence structure 100, depicted in FIGS. 1A-1J illustrates a fence grating 104 that substantially resides close to the ground, extending upward to about the top of the post 101. Alternative arrangements are also envisioned. Within FIGS. 3A-3F, an exemplary post 301 is depicted as having a notch 325 fabricated into the box tube. The notch 325 substantially severs the upper and side portions of the box tube (shown in the DETAIL B) while leaving, at least some portion of the opposing surface intact. During fabrication, and as previously described, the post 301 upper portion 302 will be bent such that the notch 325 will close upon itself, whereupon the adjoining edges of the box tube will be welded together and an overhang 302 formed. This post 301, having an overhang 302 similar to that described previously, and as shown in the depiction, can comprise a cap 306 to enclose the inner volume from human or environmental intrusion and holes 320. Such an overhang may be combined with additional rails or security wiring. In the depiction shown in FIGS. 3A-3F, the upper portion overhang 302 of the notched post is fabricated with a two pairs of holes 320 to accept mounting bracket assembly fasteners to ultimately mount a shorter version of the fence grating (shown in FIGS. 8A-8C). The notch 325 fabricated in the box tube can take on various angles dependent on the overhang angle desired. Holes, notches, and any post surface treating operations may require the component, including posts, rails, mounting brackets, and clips, to be re-treated; either overall or isolated to the area of post treatment processing. Some components may be entirely fabricated before such treatment occurs.

Turning to FIGS. 2A-2F, an exemplary straight fence post 201 is depicted in various views: isometric, face, side, detail, top and cross section (FIGS. 2D, 2B, 2A, 2E, 2C respectively). The illustration depicts a post 201 comprising three pairs of matched holes 220 along the two opposing wider sides of the post (additional holes, from 8 to sixteen or more may be fabricated into the post). Accompanying the depicted post 201, the top view depicts an exemplary cap 206 (also shown in FIG. 2F) fabricated from materials as described previously and attached to the top of the post 201. The cap 206 is welded to the upper end of the post 201 like that of the overhanging post 301, of FIGS. 3A-3F, and for similar reasons. An external press fit cap or casting cap may be utilized in lieu of a welded cap. Wall thickness of post 201, or 301, which can vary by design, is depicted at 0.120 inches. Fabricated from 2×4 box tubing the post surface treatment fabrication process, such as drilling, may require retreatment of the entire post or those areas affected. Holes 220 are depicted in the cross section, SECTION A-A, as aligned and opposing each other and may be from 0.250 to 0.500 inches in diameter, or from 0.4921 inches to 0.750 inches. Holes on opposing sides of a post may be aligned (as shown) or offset with respect to their position along the length (height) of the post. Holes 220 may be positioned at predetermined locations from the edge of the post, such as from one inch to two or more inches across the wide side of the box section, or 1.125 inches from the edge of the wide sides. Locations of holes 220 can be twelve inches from the top (not accounting for the cap) and at thirty six inches intervals down the post's length. Post 201 may be ninety eight inches in length or more, not including length necessary for insertion into a foundation. Cap 206 of may be 0.188 inches thick, as shown at the left of DETAIL B, and add substantially the same amount to the length of the post.

Representative of an exemplary mounting bracket assembly 401*a*-401*d*, FIGS. 4A-4D depicts several views, including a top view 401*d*, front view 401*c*, side view 401*b*, and isometric view 401*a* (FIGS. 4D, 4C, 4B, 4A respectively). The mounting bracket assembly 401*a*-401*d* is fabricated from two plates 411 and 421, a substantially rectangular mounting plate 411, and a tab 421 (also formed from plate). The plate thickness of each may be from 0.250 inches (nominal); may be thinner, thicker or different to one another. Welding 451 joins the two plates 411, 421 in the depicted configuration given the requirement for the mounting plate to rest flush with a fence post once installed. Slots 441 in the mounting plate may comprise 0.438 inch diameter ends with a center-to-center distance of 2.500 inches, while the slot 431 in the depicted tab 421 may comprise similar diameter ends, with a center to center distance of only 0.500 inches. All dimensions (fixed or nominal) are only exemplary and can be varied dependent on the specification design requirements.

Although the rails may take various configurations as previously mentioned, turning to FIGS. 5A-5F shows an exemplary rail 503*a* (FIG. 5E) having a hole and slot arrangement along each side of a 2×2 box tube. The holes 523 in the ends (see DETAILS B & C, FIGS. 5B, 5C respectively) of rail 503*b* (FIGS. 5A-5C) are depicted not as round but substantially square, although round holes can be used. Substantially square holes can accommodate the square shoulder of a carriage bolt to prevent spinning of the bolt during installation and tightening. Slots 513 in the rail 503*b* (as well as those of 503*a*) are depicted typically comprising ends dimensioned at 0.438 inches diameter with center-to-center distances of 1.500 inches nominally. Rail 503*a* as well as rail 503*b* depict a center section absent slots. The SECTION A-A detail shows the rail 503*a* as having a square cross section.

Figure 6:
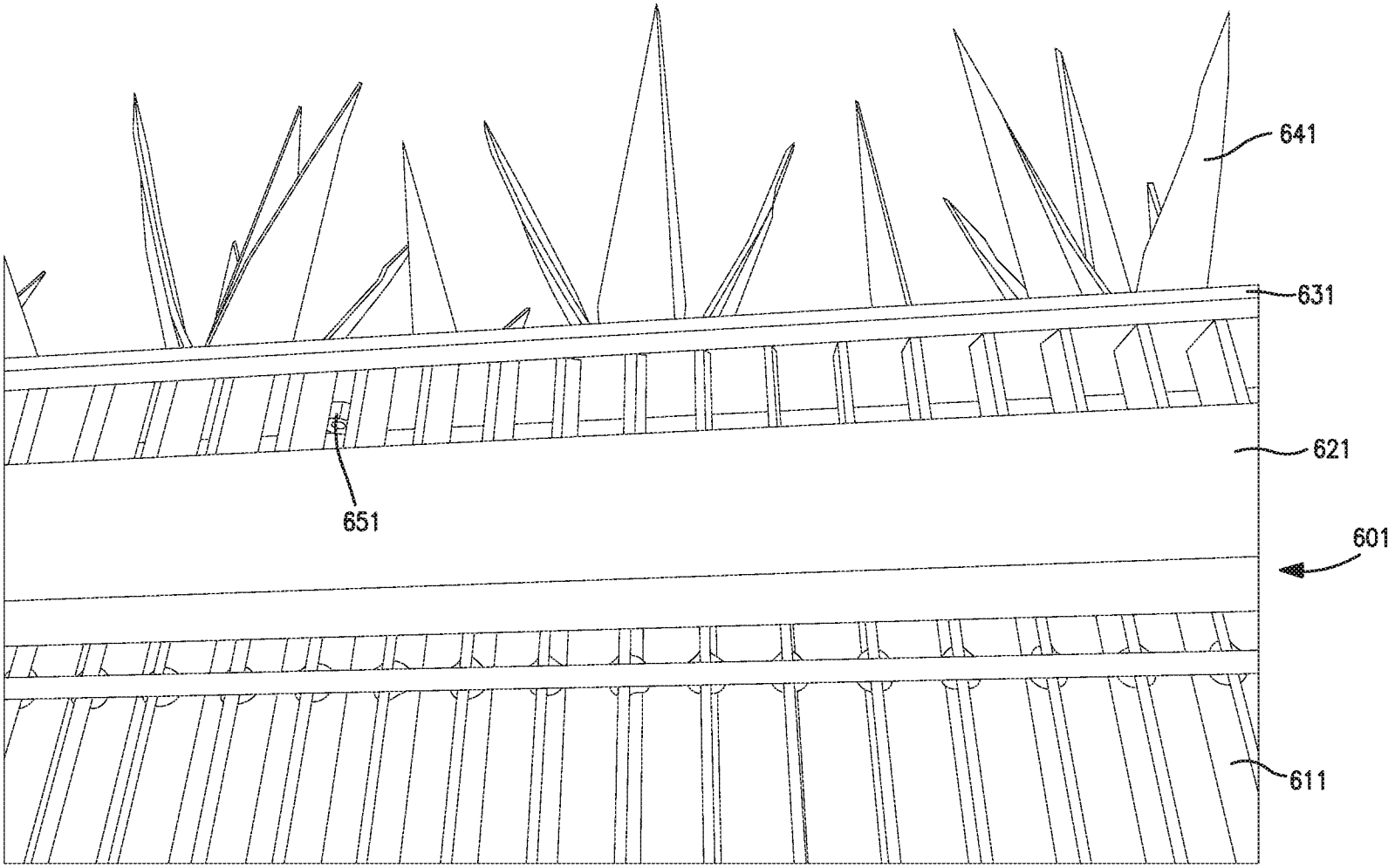
FIG. 6 illustrates a rear upwardly facing view of an embodiment of a fence structure portion comprising protruding spikes.

A fence structure 601 may be topped with sharp or protruding spikes 641 or finials mounted to a plate 631, as illustrated in the exemplary embodiment of FIG. 6. The illustration depicts fence grating 611, a rail 621, the plate 631 to which spikes 641 are mounted and a nut 651 securing the spike topping plate 631 to the grating top. The topping plate may correspond with a top rail or form the top rail and be mounted either to the rail or directly to the post via the mounting bracket assemblies.

Figure 7A:
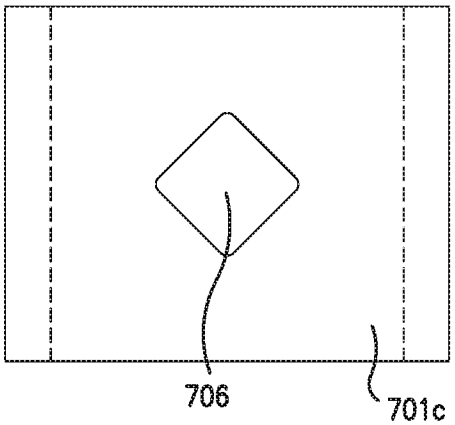
FIGS. 7A-7R illustrate various views of various embodiments of a fence clip and fence clip assembly.
Figure 7B:
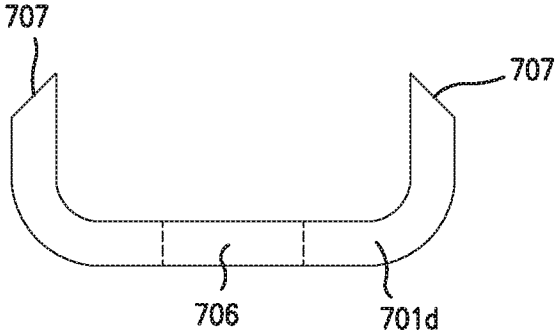
Figure 7C:
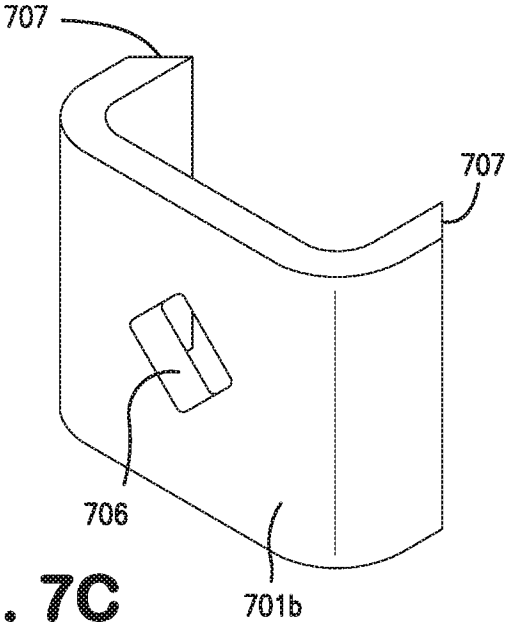
Figure 7D:
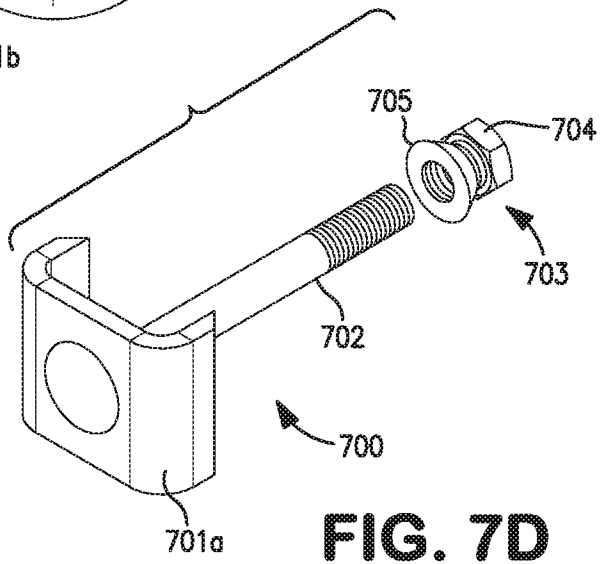
Figure 7E:
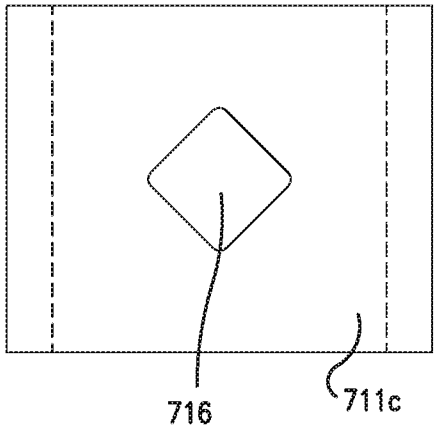
Figure 7F:
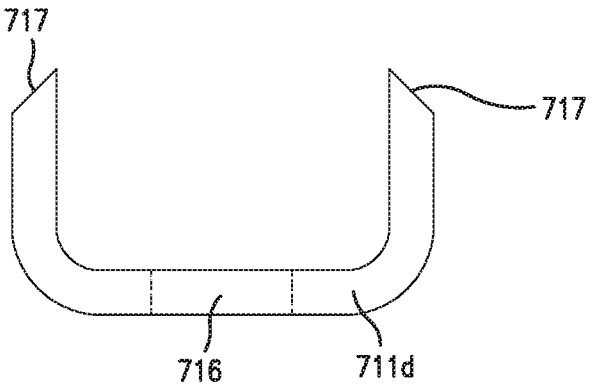
Figure 7G:
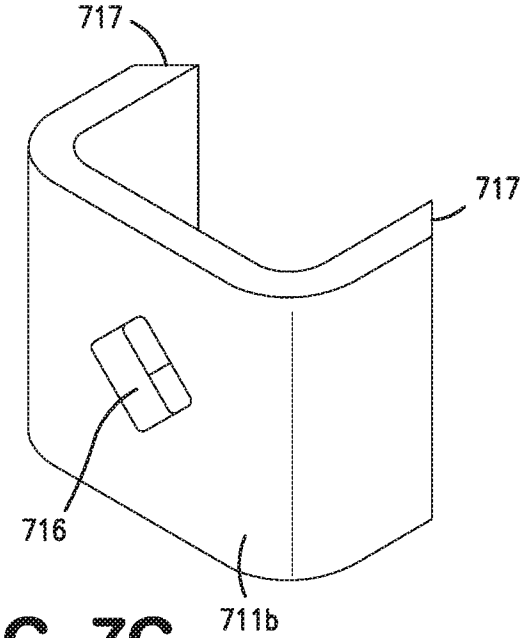
Figure 7H:
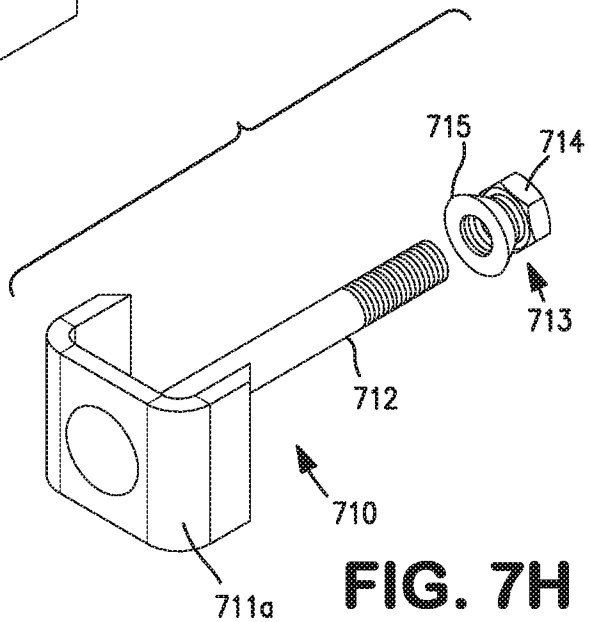
Figure 7K:
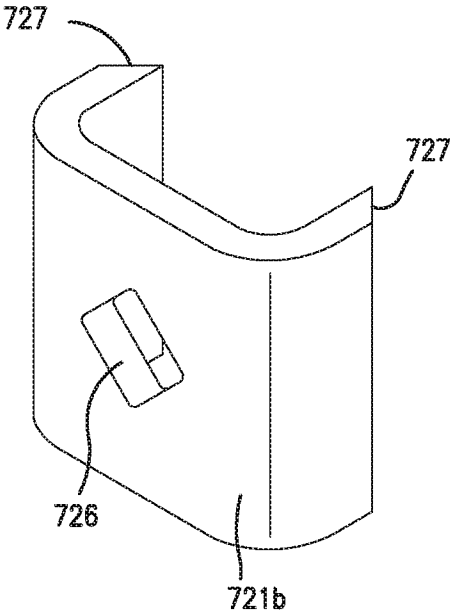
Figure 7L:
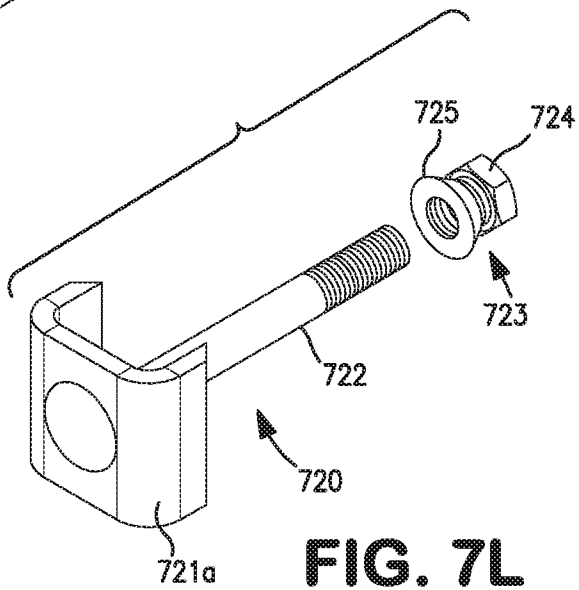
Figure 7I:
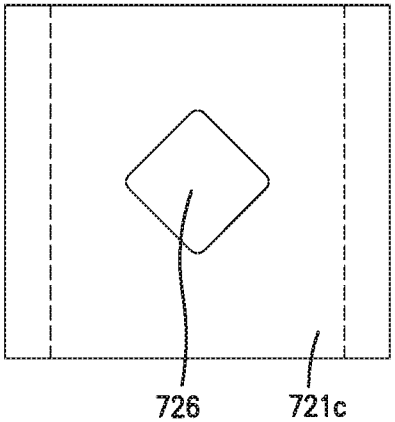
Figure 7J:
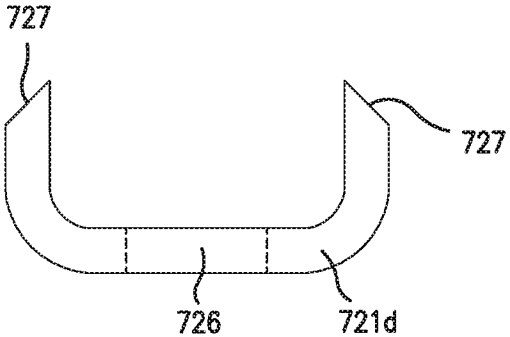
Figure 7P:
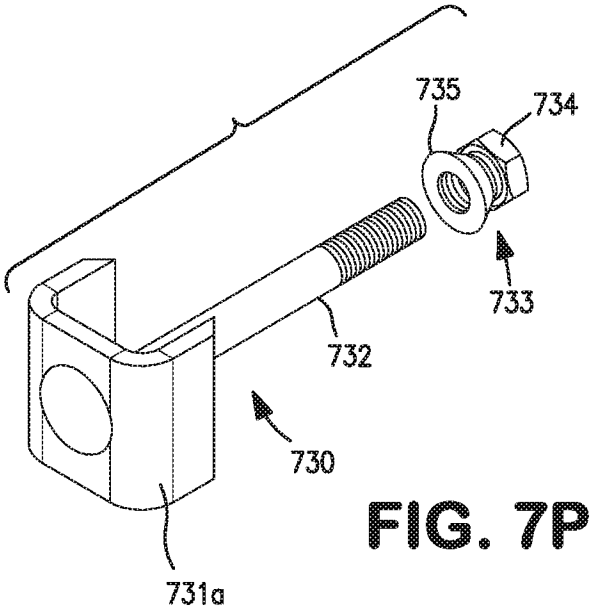
Figure 7O:
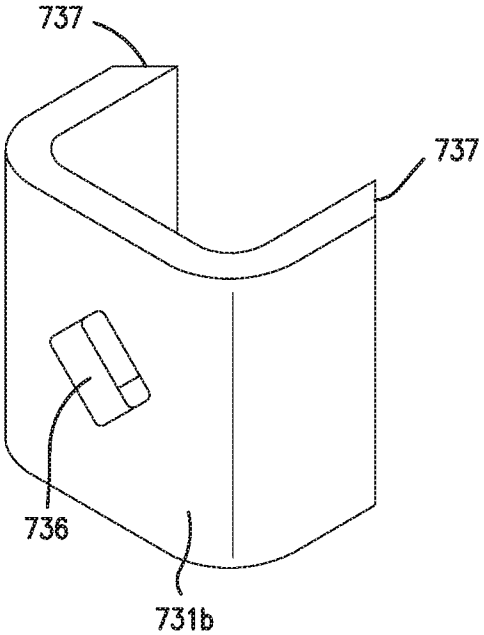
Figure 7M:
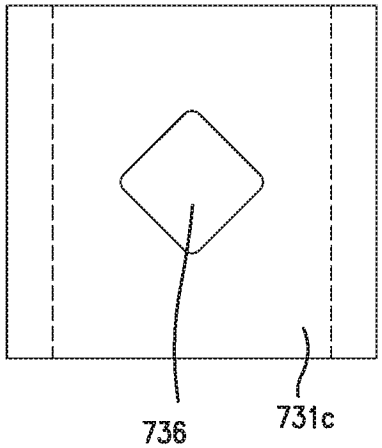
Figure 7N:
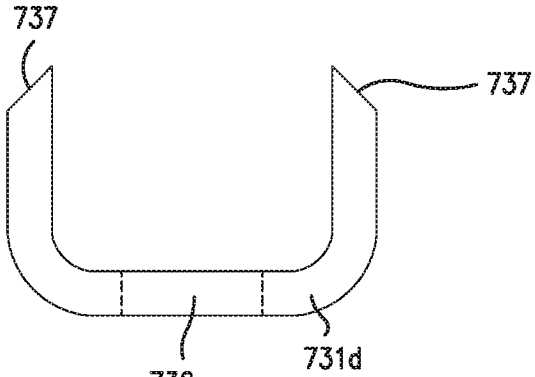
Figure 7Q:
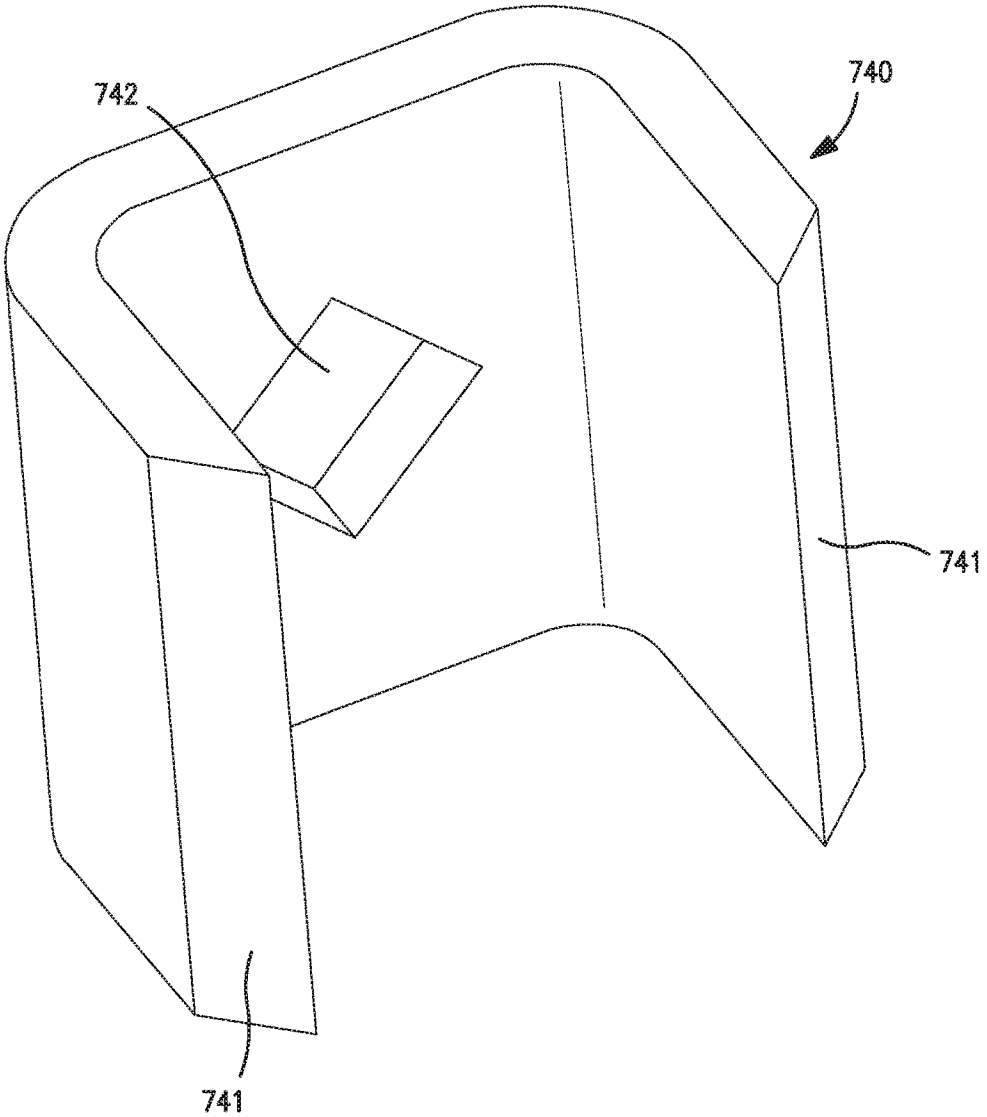
Figure 7R:
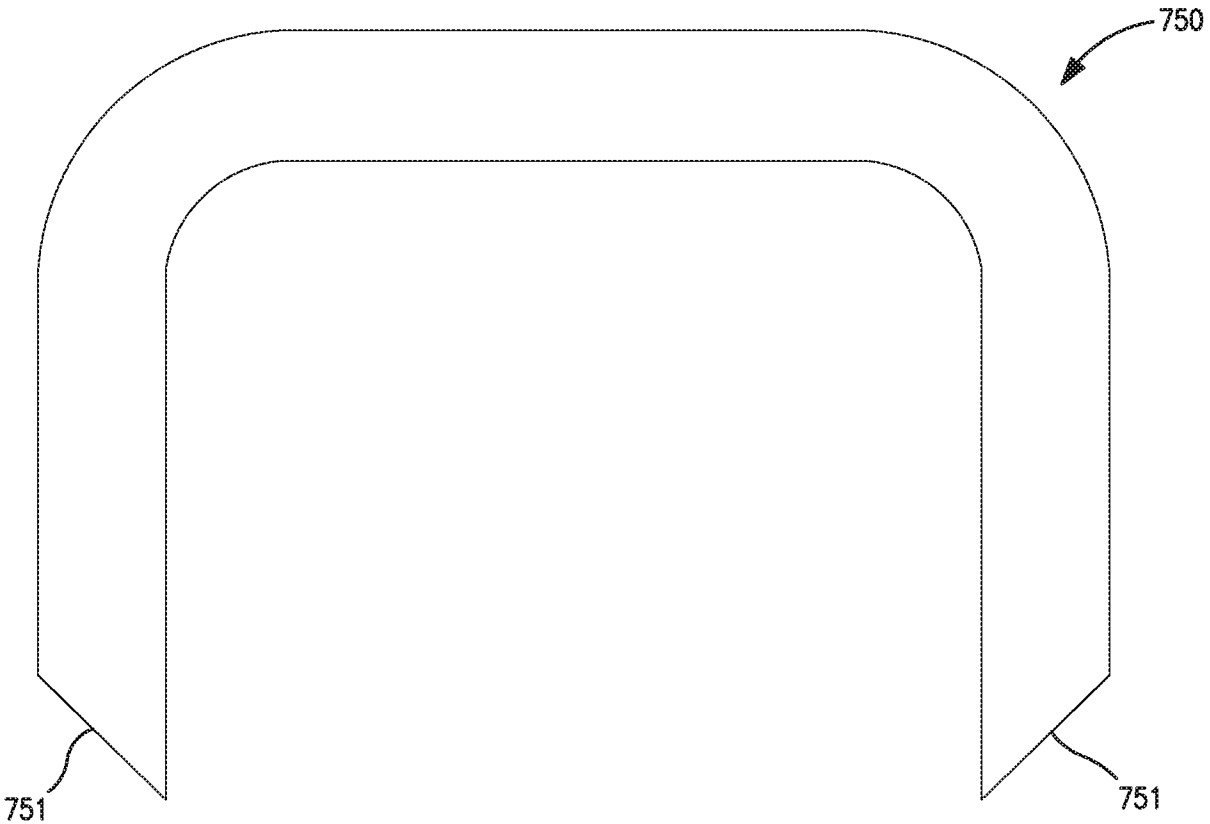

Turning to FIGS. 7A-7R, alternate exemplary embodiments of fence clips 701*a*-701*d*, 711*a*-711*d*, 721*a*-721*d*, 731*a*-731*d*, 740, and 750, and assemblies 700, 710, 720, 730 are depicted. A fence clip may be formed from a substantially rectangular flat plate having a front and back surface and bent into a C-shape about the back surface forming a left tang and right tang, as shown. Alternatively, the fence clip may be cut from a preformed channel having the edges tapered (or beveled) as shown. The ends of the tangs are shown having a tapered or beveled end. The fence clips 701*a*-701*d*, 711*a*-711*d*, 721*a*-721*d*, 731*a*-731*d*, 740, and 750 depicted in FIGS. 7A-7R exhibit alternative dimensions and tapered (beveled) ends 707, 717, 727, 737, 741, 751, providing for varied dimensioned fence grating and limiting the ability of a would be assault on the clip to succeed.

Tapering the clip in this fashion causes tooling to slip from the surface further thwarting an attack on the fence structure. The fence clips 701*a*-701*d*, 711*a*-711*d*, 721*a*-721*d*, 731*a*-731*d*, 740, and 750 may also, as shown have a substantially square hole 706, 716, 726, 736, 742 for retaining the head of carriage bolt 702, 712, 722, 732 and restrict it from spinning during the tightening of the associated security nut 703, 713, 723, 733; each nut shown comprising its hex head driving portion 704, 714, 724, 734, still attached to the threaded securing portion 705, 715, 725, 735; wherein the hex portions 704, 714, 724, 734 will break off at a predetermined torque. FIG. 7Q specifically depicts an isometric view of one embodiment of a fence clip 740, comprising mitered ends 741 and square hole 742. FIG. 7R is a top view of an embodiment of a fence clip 750 further exhibiting mitered ends 751.

Figure 8A:
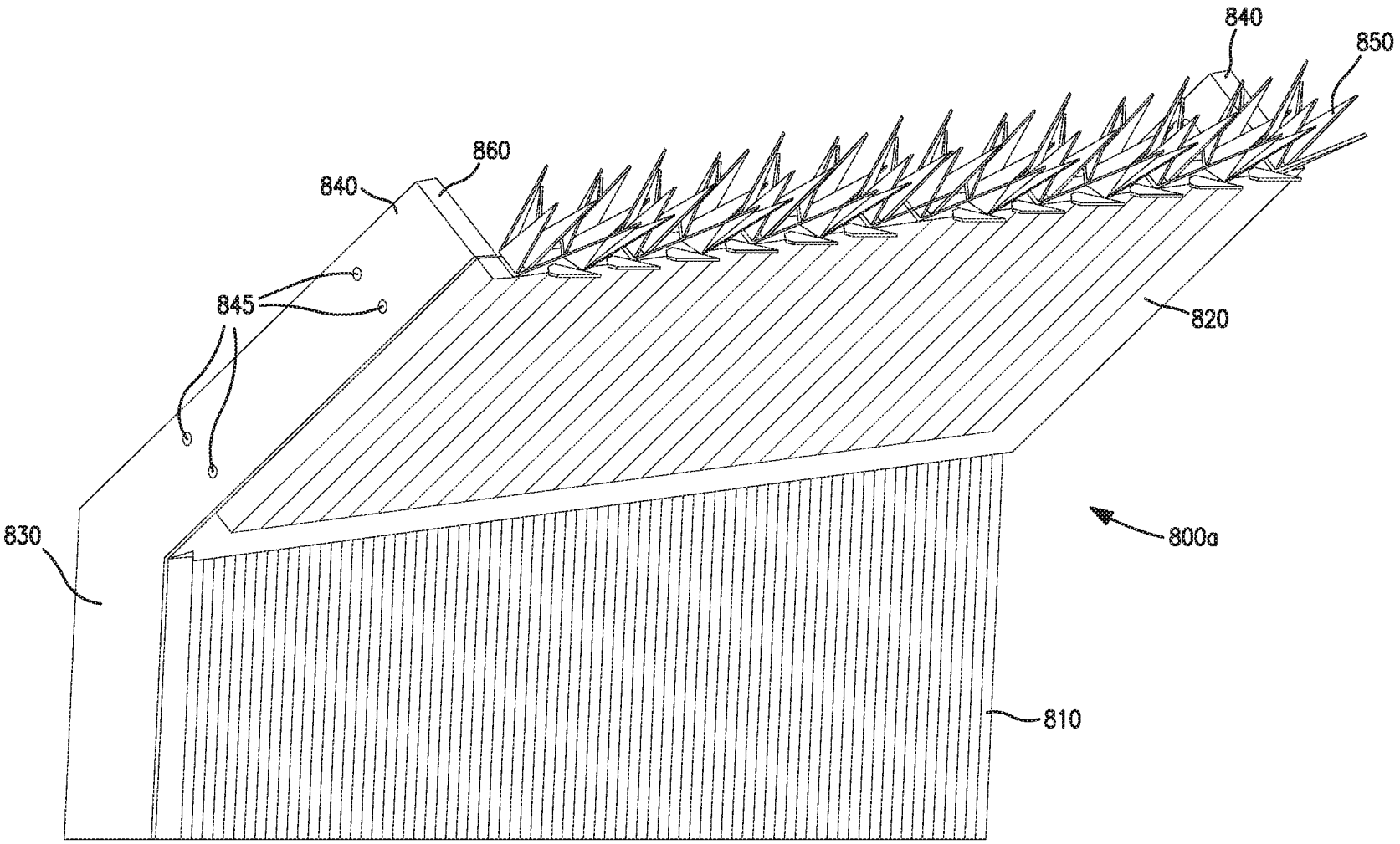
FIG. 8A illustrates an isometric view of an embodiment of an upper portion of a fence structure comprising spikes attached atop the upper portion of an overhanging fence grating.
Figure 8B:
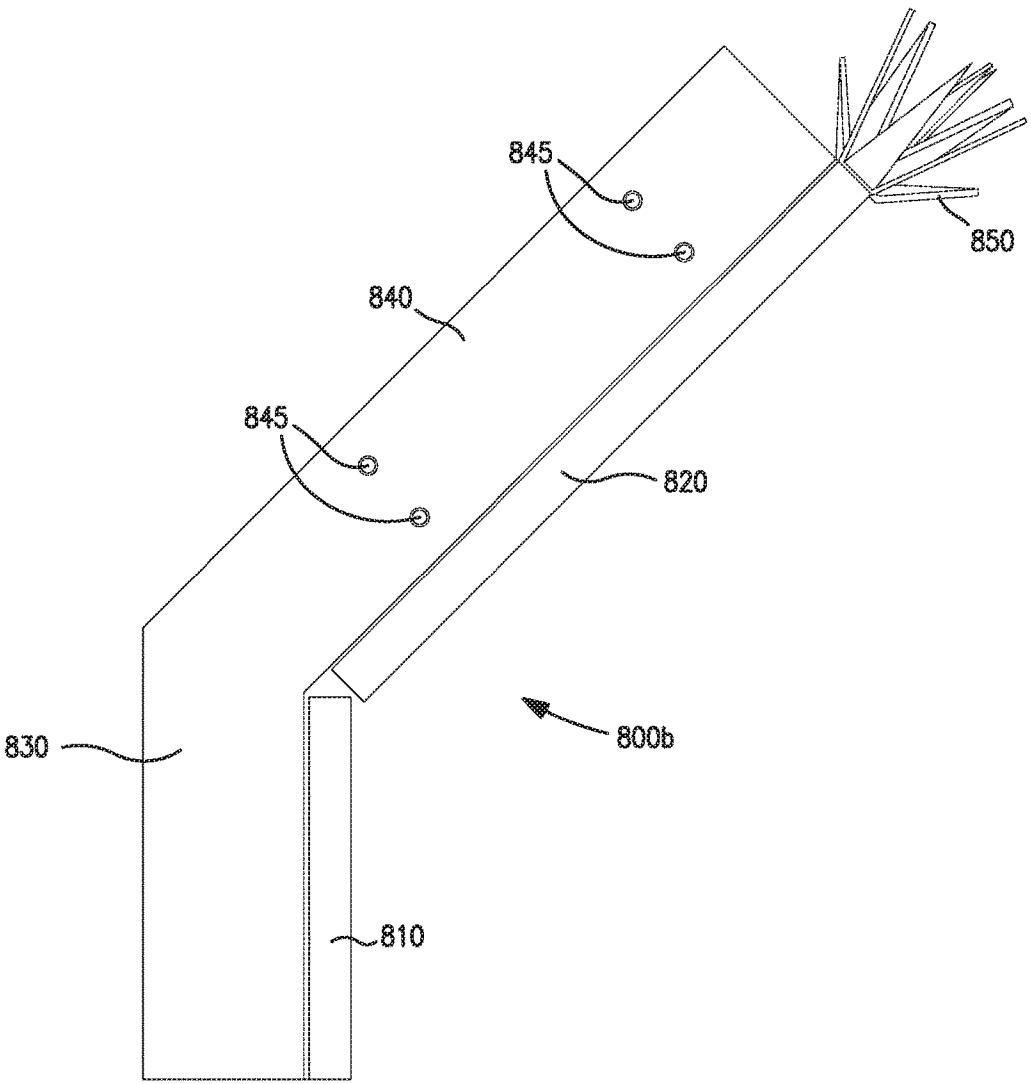
FIG. 8B illustrates a side view of an embodiment of an upper portion of a fence structure comprising spikes attached atop the upper portion of an overhanging fence grating.
Figure 8C:
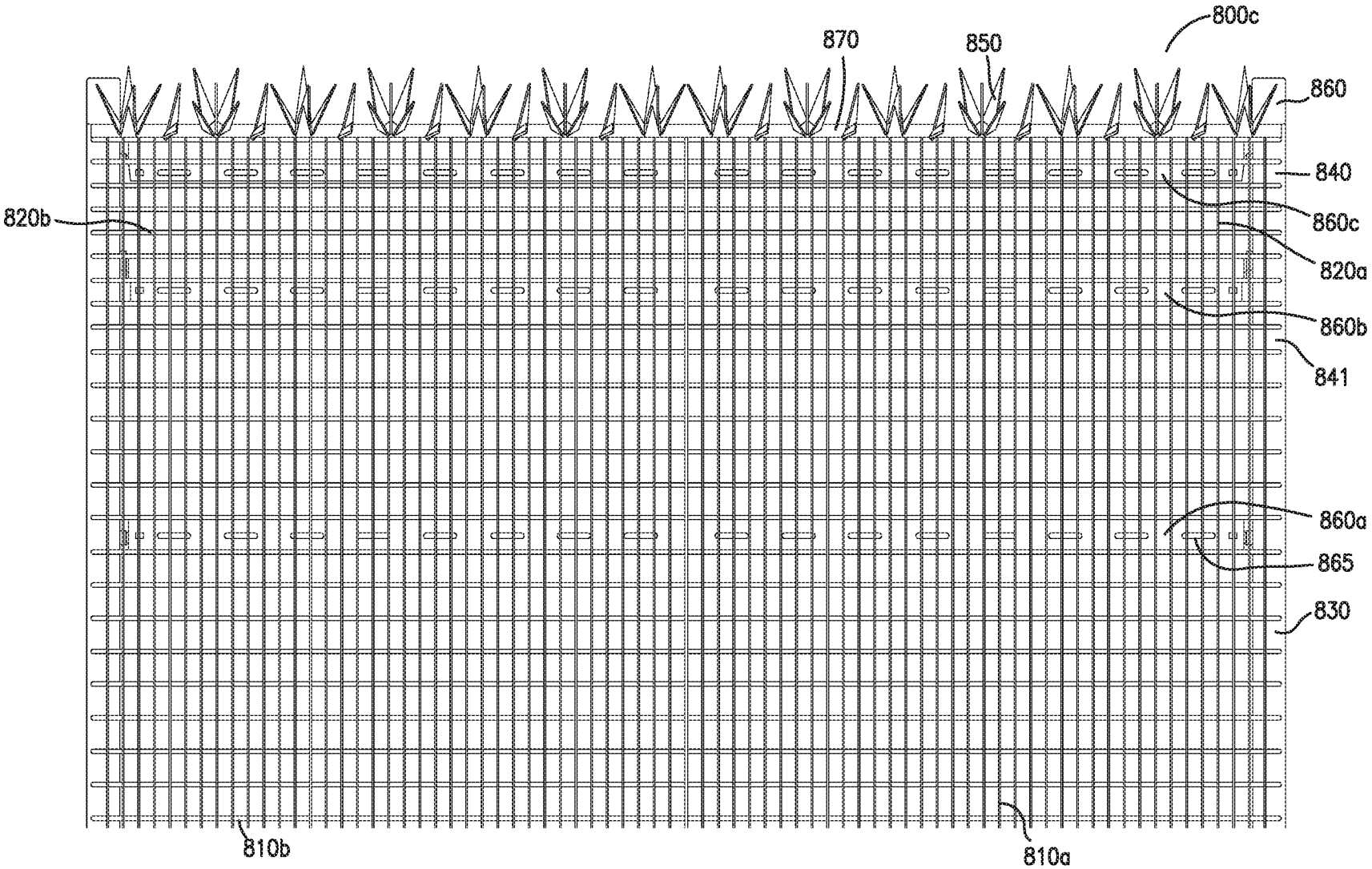
FIG. 8C illustrates a front mid-to-upper view of an embodiment of a portion of a fence structure comprising spikes attached atop the upper portion of an overhanging fence grating.

FIGS. 8A-8C depict multiple views (isometric view 800*a*, side view 800*b*, and front view 800*c* of an exemplary embodiment of the fence structure comprising topping plate 870 with spikes 850, including overhang post portions 840 of posts 830 and overhang fence gratings 820 mounted to the overhanging portion of the posts 840, via rails 860*b* and 860*c* and mounting bracket assemblies as described previously (not shown). In these embodiments, the fence structure topping plate 870 is attached to the overhang fence grating 820 itself, such as by welding, as opposed to the post or rail directly. The overhang post ports 840 are further depicted comprising two paired holes 845. FIGS. 8A and 8B depicts a single grating arrangement for both the overhang fence 820 grating and the upright fence grating 810; whereas FIG. 8C depicts a double grating arrangement for both the overhang fence grating 820*a*, 820*b* and the upright fence grating 810*a*, 810*b*. FIG. 8C additionally illustrates an upper rail 860*a* and two overhang rails 860*b* and 860*c*, each with slots 865. Although the topping plate 870 comprising spikes is shown in FIG. 8C as a single unit spanning both overhang fence gratings 820*a*, and 820*b*; the topping plate comprising spikes may be provided individually, either factory installed on the top of the overhang fence grating, such as by welding, or attached via fasteners on-site during installation.

Figure 9A:
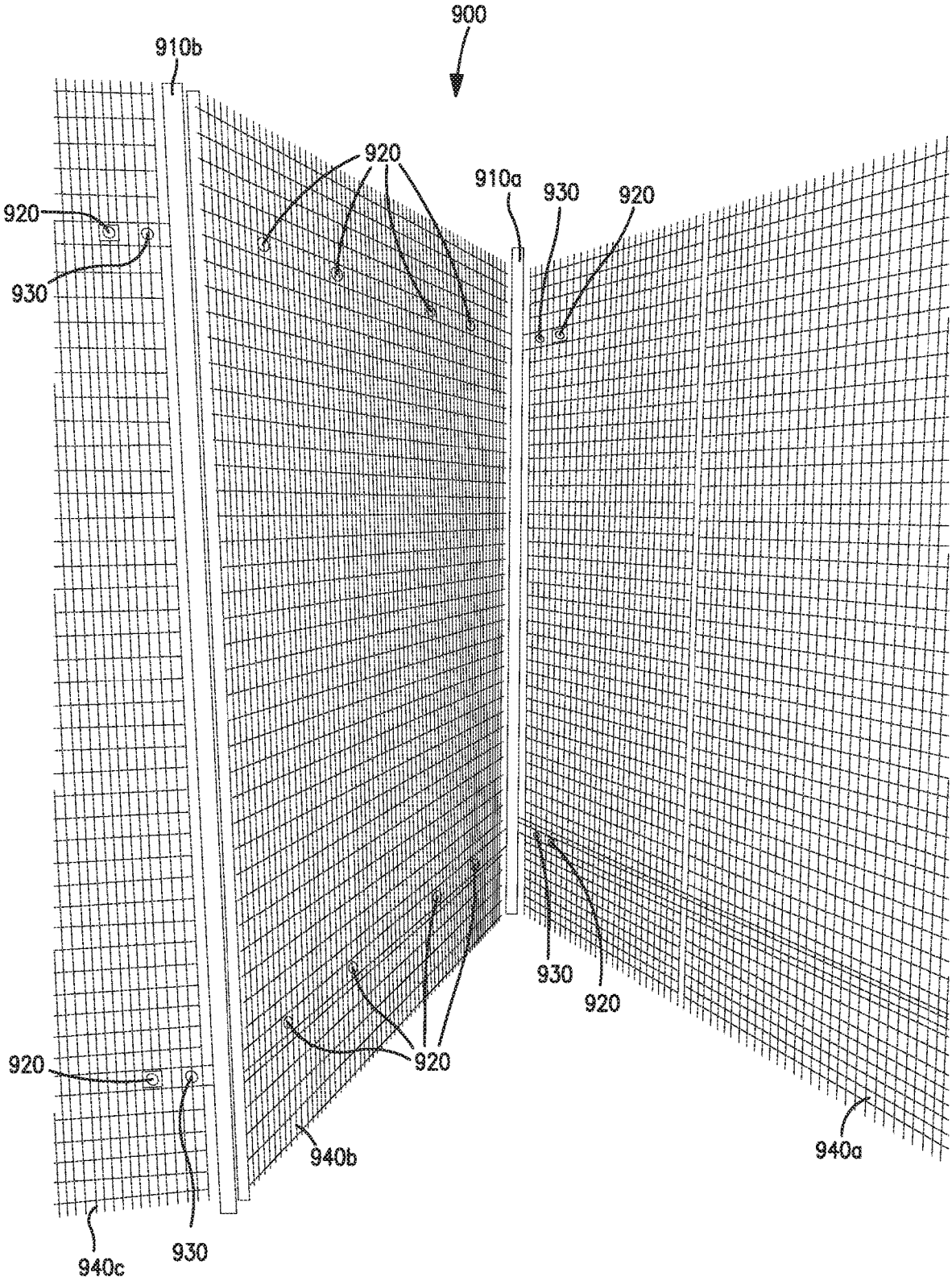
FIG. 9A illustrates a front view of an embodiment of a portion of a fence structure comprising a hinge arrangement as might be installed in an angular arrangement to avoid an obstruction.
Figure 9B:
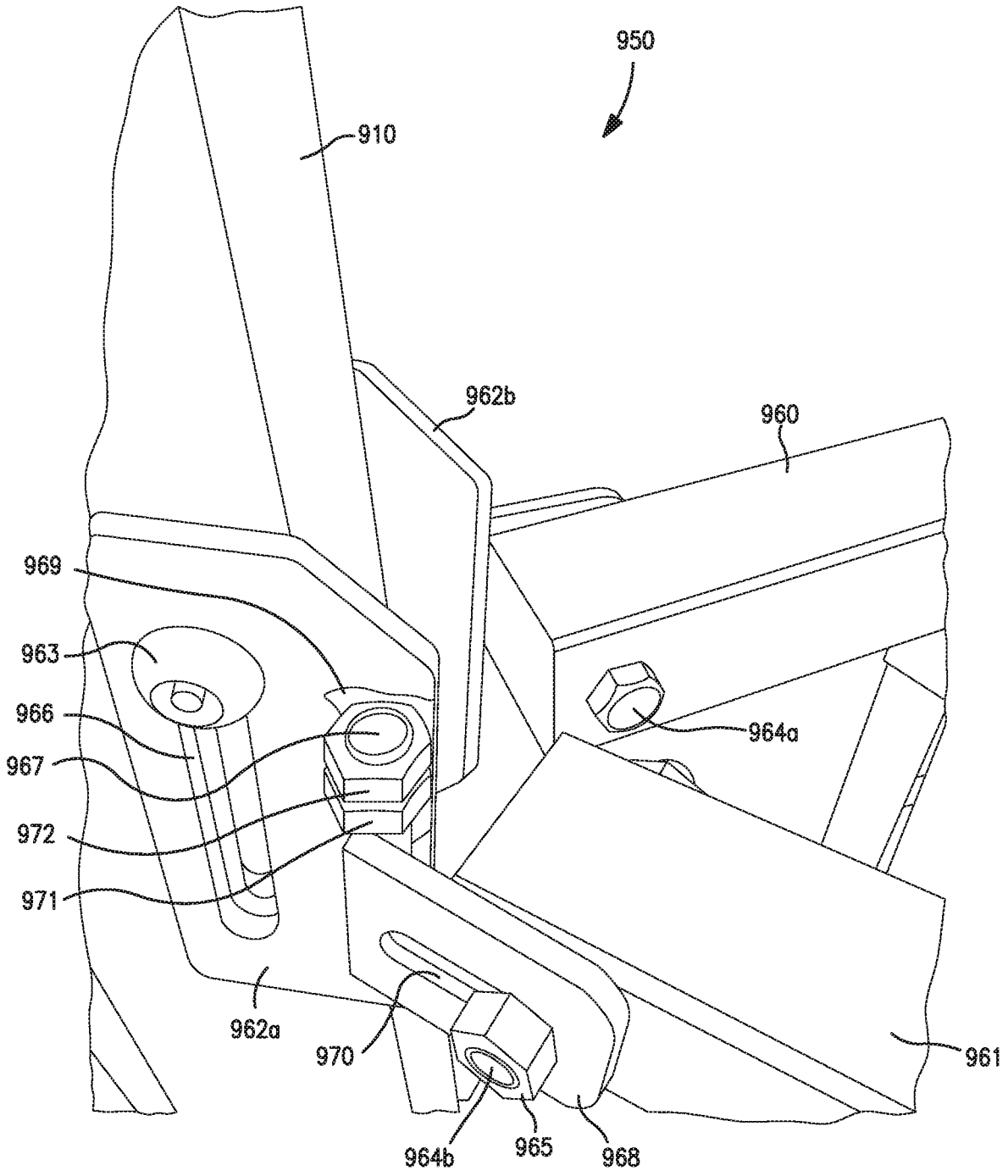
FIG. 9B illustrates close up detail view of an embodiment of a hinge used in an embodiment of fence structure, such as that shown in FIG. 9*a*.

FIG. 9A-9B depict exemplary embodiments of a fence structure, FIG. 9A, illustrating a fence structure 900 incorporating an angle of fence grating 940*a* (partial) to 940*b* and then to 940*c* (partial) that might be accomplished using a hinge arrangement 950, as shown in FIG. 9B. The depiction of FIG. 9A partially shows fence clip assemblies 920, rail mounting bracket assemblies 930, and fence posts 910*a* and 910*b*. The an angular arrangement may be performed to account for an obstruction, such as a tree, building or other object that can't be moved, or move the fence structure away from an object that a would-be intruder might use to aide in scaling the fence structure. Hinge arrangement 950 of FIG. 9B comprises post 910, to which hinge plate 962*a*, 962*b* (partially shown) are attached via security fastener bolts 963, through vertical hinge plate slots 966. Now referring to the near-side hinge, FIG. 9B depicts a hinge pivot 972 attached via weld 969 to the hinge plate 962*a* (lower pivot not shown), capturing hinge pin 967 that is welded to slotted (970) tab 968; such that rail 961, attached via fastener bolt 964*b* and nut 965, may swing having a vertical axis of movement. Jamming nut 971 is provided to lock the pivot into position once the position of rail 961 is determined and set. The pivot 972 and jamming nut 971 positions may be reversed or provided at the bottom or absent jamming nut 971. A similarly arranged hinge is provided for rail 960 attached to a corresponding hinge arrangement via bolt 964*a*.

Figure 10A:
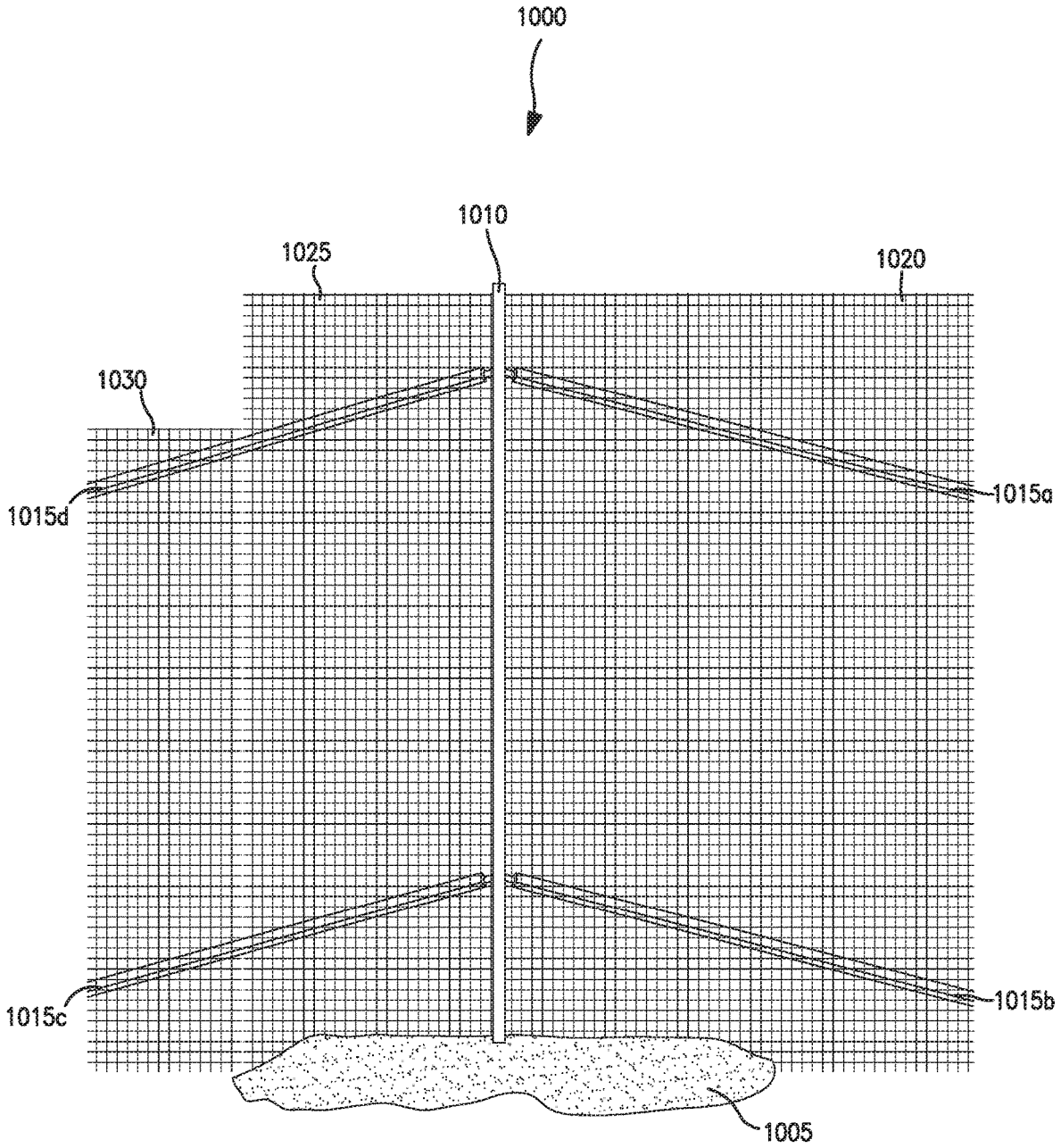
FIG. 10A illustrates an overall front view of an embodiment of a portion of a fence structure wherein the structure is arranged to follow the terrain.
Figure 10B:
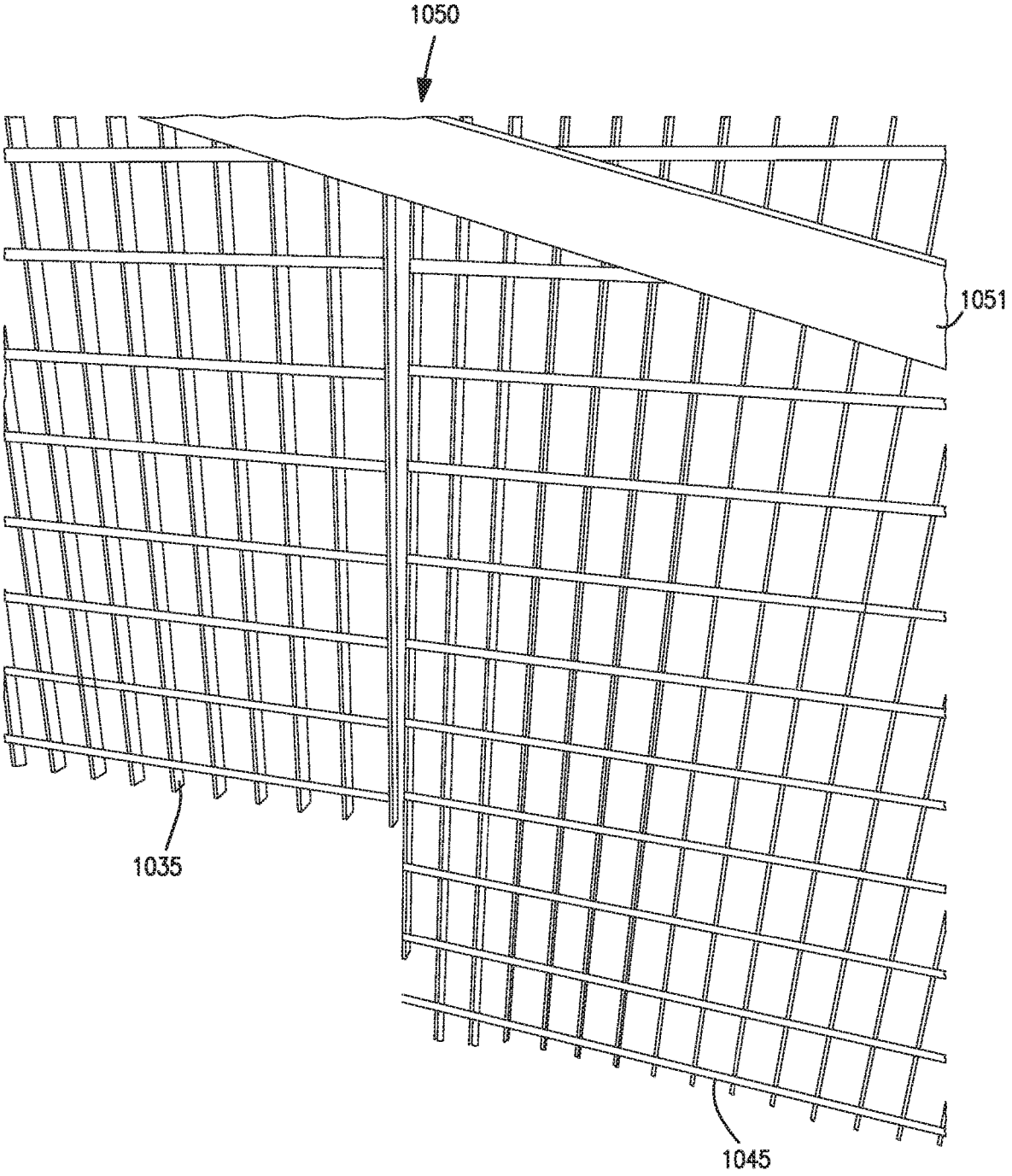
FIG. 10B illustrates a rear close-up detail view of an embodiment similar to FIG. 10*a* wherein the rail is angled and a portion of grating is elevated to follow terrain.
Figure 10C:
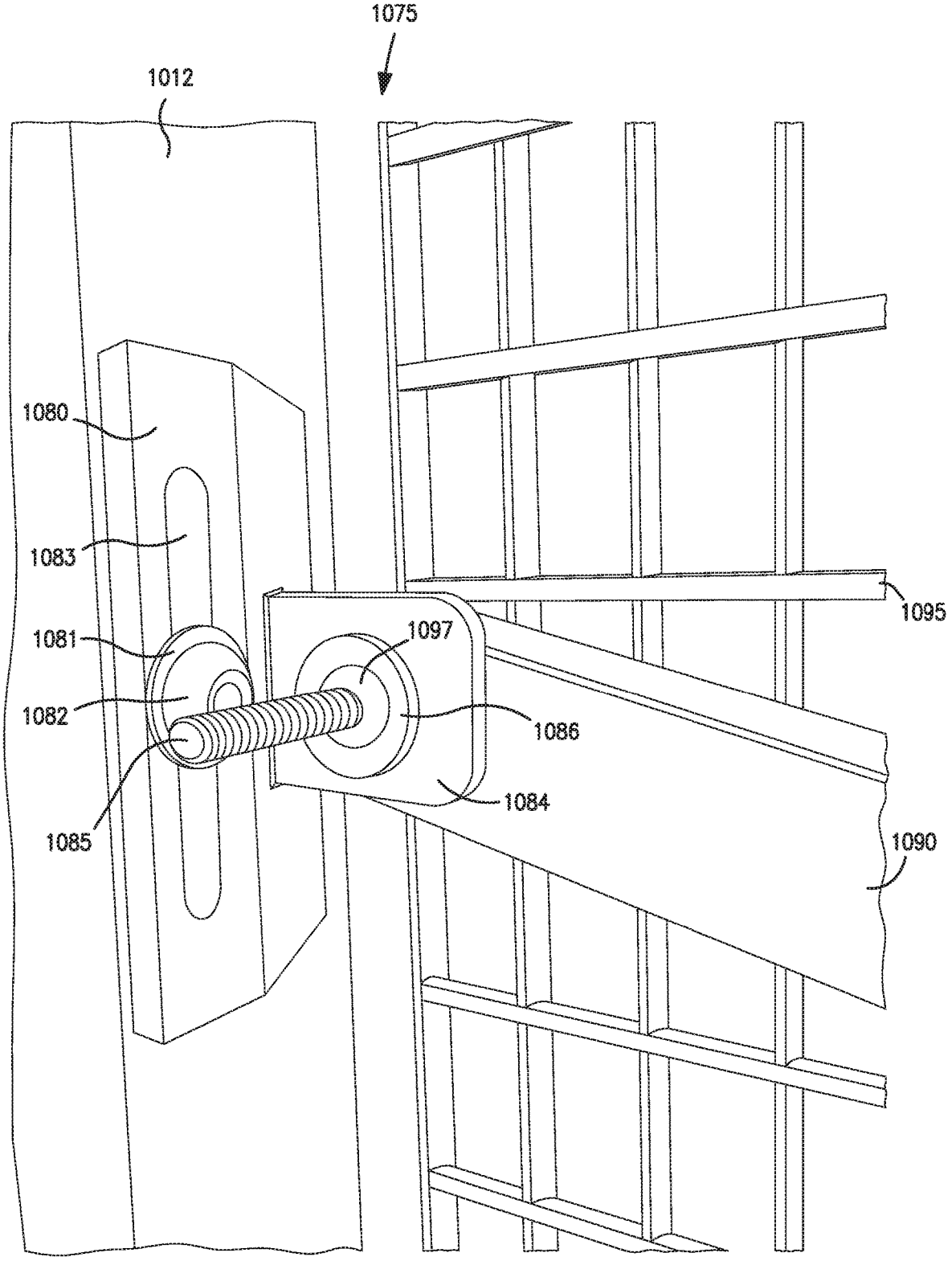
FIG. 10C illustrates a rear close-up detail view of an embodiment of a portion of a fence structure angled rail connection to a mounting bracket comprising security bolts, washers and a security nut.

Uneven terrain following is depicted in FIGS. 10A-10C illustrating exemplary embodiments of a fence structure 1000, 1050, and 1075 respectively. In FIG. 10A, fence grating 1020, 1025 and 1030 is formed to follow the shape of the obstacle. The rails 1015*a*-*d*, attached to post 1010 are also shown (FIG. 10A-10C) having an attachment angle alternative to ninety degrees (90°) from the post (or non-level based on a spirit level). Fence grating 1025 is taller than that of 1030 and contoured at the bottom to conform around the obstruction 1005. As previously described, the fence structure may use various gratings of various lengths to compensate for uneven terrain. FIG. 10B depicts fence structure 1050 wherein the right grating 1045 extends down relative to the left grating 1035, in conjunction with rail 1051, that avoids an obstacle (not shown). The fence gratings may be extended or shorted as necessary and fabricated as such, or modified in the field. The mounting bracket assembly comprising plate 1080, having slot 1083, and tab 1084 shown in FIG. 10C illustrates the fastening of angled rail 1090 to the mounting bracket tab 1084 via security bolt 1085, washer 1086 and security nut 1097 to retain the fence grating. The mounting bracket assembly plate 1080 is retained to the post 1012 by fastener security bolt 1082, washer 1081, and blind nut (not shown). As previously discussed, this angular arrangement of the mounting bracket assembly may provide additional support for the fence grating 1095 when uneven terrain is encountered.

STATEMENT REGARDING PREFERRED EMBODIMENTS

While the invention has been described with respect to preferred embodiments, those skilled in the art will readily appreciate that various changes and/or modifications can be made to the invention without departing from the spirit or scope of the invention as defined by the appended claims. All documents cited herein are incorporated by reference herein where appropriate for teachings of additional or alternative details, features and/or technical background.

What is claimed is:

1. A fence structure comprising:

two or more posts comprising horizontally aligned paired holes at two or more predetermined locations down each opposing side;

two or more mounting brackets comprising a substantially T-shape defined by a tab plate, having a horizontally oriented slot, affixed to a mounting plate, having two vertically oriented parallel slots astride said tab plate extending outward therebetween, said horizontally oriented slot and said two vertically oriented parallel slots defining a relative orientation, at least two of said two or more mounting brackets fastened to each of said two or more posts at said horizontally aligned paired holes;

two or more rails fastened to and between each of said two or more posts via said two or more mounting brackets, and about each end of said two or more rails;

one or more fence grating comprising a plurality of vertical members; and two or more fence clips comprising an outer face, an inner face, and two tapered edges at opposing ends, said tapered edges extending the length of said opposing ends and from said inner face to said outer face, wherein each of said two or more fence clips are fastened to said two or more rails, capturing at least two of said plurality of vertical members, said two tapered edges residing on either side of said at least two of said plurality of vertical members and residing proximate to their corresponding two or more rails, and said relative orientation of said horizontally oriented slot and said two vertically oriented parallel slots of each of said two or more mounting brackets provide differential freedom of movement for assembly of said fence structure in both a horizontal and vertical orientation.

2. The fence structure of claim 1, wherein one surface of said two or more rails is co-planer with one surface of said two or more posts.

3. The fence structure of claim 1, wherein said one or more fence grating overlaps at least one of said two or more posts.

4. The fence structure of claim 1, wherein at least one of said two or more posts have horizontally aligned paired holes at two or more predetermined locations down adjacent sides to accept fastening of said one or more mounting brackets.

5. The fence structure of claim 1, wherein said tab plate is welded to said mounting plate.

6. The fence structure of claim 1, wherein said two or more mounting brackets comprise a vertical placement tolerance of about +/−2 inches.

7. The fence structure of claim 1, wherein said two tapered edges provide zero clearance to each said corresponding said two or more rails.

8. The fence structure of claim 1, wherein the two or more fence clips comprise a C-shaped cross section having said tapered edges oriented vertically.

9. The fence structure of claim 1, wherein said two or more fence clips comprise a through hole about a center portion of said fence clip.

10. The fence structure of claim 9, wherein said through hole is a square.

11. The fence structure of claim 1, wherein at least one of said two or more posts comprise an overhang portion.

12. The fence structure of claim 11, wherein said overhang portion is fabricated by a welded closed V-shape notch cut into three adjacent sides of each of said two or more posts.

13. The fence structure of claim 1, wherein at least one of said two or more posts comprises a cap.

14. The fence structure of claim 1, wherein at least one of said two or more posts are terminal posts.

15. The fence structure of claim 1, wherein at least one of said two or more posts comprise a cross section of about two inches by four inches.

16. The fence structure of claim 1, wherein said two or more rails comprise a through hole at each end.

17. The fence structure of claim 16, wherein said through hole in said two or more rails is square.

18. The fence structure of claim 1, wherein said two or more rails comprise a series of through slots about their lengths.

19. The fence structure of claim 1, wherein said through slots are fabricated to accept a fence clip comprising opposing ends having an end tab providing resistance to rotation.

20. The fence structure of claim 1, wherein said two tapered edges face two correspondingly adjacent vertical members to said captured at least two of said plurality of vertical members.

* * * * *